US010151037B2

(12) United States Patent
Hoeprich, Jr. et al.

(10) Patent No.: US 10,151,037 B2
(45) Date of Patent: Dec. 11, 2018

(54) ELECTROCHEMICAL FLOW-CELL FOR HYDROGEN PRODUCTION AND NICOTINAMIDE DEPENDENT TARGET REDUCTION, AND RELATED METHODS AND SYSTEMS

(71) Applicant: LAWRENCE LIVERMORE NATIONAL SECURITY, LLC, Livermore, CA (US)

(72) Inventors: Paul D. Hoeprich, Jr., Pleasanton, CA (US); Sangil Kim, Pleasanton, CA (US)

(73) Assignee: Lawrence Livermore National Security, LLC, Livermore, CA (US)

( * ) Notice: Subject to any disclaimer, the term of this patent is extended or adjusted under 35 U.S.C. 154(b) by 199 days.

(21) Appl. No.: 14/861,750

(22) Filed: Sep. 22, 2015

(65) Prior Publication Data

US 2016/0083858 A1 Mar. 24, 2016

Related U.S. Application Data

(60) Provisional application No. 62/053,659, filed on Sep. 22, 2014.

(51) Int. Cl.
*C25B 13/08* (2006.01)
*C25B 1/02* (2006.01)
(Continued)

(52) U.S. Cl.
CPC ..... *C25B 13/08* (2013.01); *C25B 1/02* (2013.01); *C25B 3/04* (2013.01); *C25B 9/00* (2013.01); *C25B 13/02* (2013.01); *C25B 15/08* (2013.01)

(58) Field of Classification Search
CPC ..... C25B 13/02; C25B 13/08; C25B 15/08; C25B 1/02; C25B 3/04; C25B 9/00; C12N 11/02; C12P 3/00; Y10S 977/799
(Continued)

(56) References Cited

U.S. PATENT DOCUMENTS 4,317,771 A 3/1982 Shiba et al.
5,393,530 A 2/1995 Schneider et al.
(Continued)

FOREIGN PATENT DOCUMENTS

JP 2008516605 A 5/2008
JP 2015110677 A 6/2015
(Continued)

OTHER PUBLICATIONS

Vuorilehto et al. (K. Vuorilehto, S. Lutz, C. Wandrey, Indirect electrochemical reduction of nicotinamide coenzymes, Bioelectrochemistry 65 (2004) 1-7).*

"Assembly of nanodiscs for use in cell-free expression using MSP1D1 protein and POPC phospholipids." Cube Biotech. 3 pgs. 2014.

"Co-Translation of Integral Membrane Proteins (MP) With Membrane Scaffold Proteins (MSP), Also Known as Nanodiscs" http://technology.sbkb.org/portal/page/329/ retrieved on Jul. 1, 2015, pp. 1-5.

(Continued)

*Primary Examiner* — Maris R Kessel
*Assistant Examiner* — Joshua L Allen
(74) *Attorney, Agent, or Firm* — Steinfl + Bruno, LLP

(57) ABSTRACT

Methods and systems for hydrogen production or production of a reduced target molecule are described, wherein a nicotinamide co-factor dependent membrane hydrogenase or a nicotinamide co-factor dependent membrane enzyme presented on a nanolipoprotein adsorbed onto an electrically conductive supporting structure, which can preferably be chemically inert, is contacted with protons or a target molecule to be reduced and nicotinamide cofactors in presence of an electric current and one or more electrically driven redox mediators. Methods and systems for production of hydrogen or a reduced target molecule are also described wherein a membrane-bound hydrogenase enzyme or enzyme capable or reducing a target molecule is contacted with protons or the target molecule, a nicotinamide co-factor and a nicotinamide co-factor dependent membrane hydrogenase presented on a nanolipoprotein particle for a time and under condition to allow hydrogen production or production (Continued)

of a reduced target molecule in presence of an electrical current and of an electrically driven redox mediator.

39 Claims, 9 Drawing Sheets

(51) Int. Cl.

| | |
|---|---|
| ***C25B 13/02*** | (2006.01) |
| ***C25B 15/08*** | (2006.01) |
| ***C25B 3/04*** | (2006.01) |
| ***C25B 9/00*** | (2006.01) |

(58) Field of Classification Search
USPC ..... 205/351, 637
See application file for complete search history.

(56) References Cited

U.S. PATENT DOCUMENTS

| | | | | |
|---|---|---|---|---|
| 6,270,649 | B1 | 8/2001 | Zeikus et al. | |
| 7,015,471 | B2 | 3/2006 | Franzen et al. | |
| 7,048,949 | B2 | 5/2006 | Sligar et al. | |
| 7,083,958 | B2 | 8/2006 | Sligar et al. | |
| 7,375,234 | B2 | 5/2008 | Sharpless et al. | |
| 8,183,010 | B2 | 5/2012 | Swartz et al. | |
| 8,883,729 | B2 | 11/2014 | Hoeprich et al. | |
| 8,889,623 | B2 | 11/2014 | Hoeprich et al. | |
| 8,907,061 | B2 | 12/2014 | Chromy et al. | |
| 9,303,273 | B2 | 4/2016 | Hoeprich et al. | |
| 9,388,232 | B2 | 7/2016 | Dasseux et al. | |
| 2004/0101741 | A1* | 5/2004 | Minteer | C12N 11/08 429/401 |
| 2004/0180369 | A1 | 9/2004 | Franzen et al. | |
| 2005/0182243 | A1 | 8/2005 | Sligar et al. | |
| 2005/0244414 | A1 | 11/2005 | Mundy et al. | |
| 2006/0189554 | A1 | 8/2006 | Mumper et al. | |
| 2006/0211092 | A1 | 9/2006 | Sligar et al. | |
| 2007/0101448 | A1 | 5/2007 | Anantharamiah et al. | |
| 2007/0117179 | A1 | 5/2007 | Kudlicki et al. | |
| 2007/0287034 | A1* | 12/2007 | Minteer | H01M 4/8605 429/2 |
| 2008/0124350 | A1 | 5/2008 | Mumper et al. | |
| 2009/0136937 | A1 | 5/2009 | Coleman et al. | |
| 2009/0186393 | A1* | 7/2009 | Baker | C12N 11/02 435/168 |
| 2009/0192299 | A1 | 7/2009 | Chromy et al. | |
| 2009/0203549 | A1 | 8/2009 | Hoeprich, Jr. | |
| 2009/0270331 | A1 | 10/2009 | Remaley et al. | |
| 2009/0311276 | A1 | 12/2009 | Hoeprich et al. | |
| 2010/0203609 | A1 | 8/2010 | Yacoby et al. | |
| 2011/0059549 | A1 | 3/2011 | Coleman et al. | |
| 2011/0178029 | A1 | 7/2011 | Knudsen et al. | |
| 2011/0195450 | A1 | 8/2011 | Kudlicki et al. | |
| 2012/0178029 | A1 | 7/2012 | Huang et al. | |
| 2012/0245101 | A1 | 9/2012 | Anantharamaiah et al. | |

FOREIGN PATENT DOCUMENTS

| | | | |
|---|---|---|---|
| WO | 2000/065099 | A1 | 11/2000 |
| WO | 2002/040501 | A2 | 5/2002 |
| WO | 2004/094651 | A2 | 11/2004 |
| WO | 2004/112214 | A2 | 12/2004 |
| WO | 2005/070400 | A1 | 8/2005 |
| WO | 2006/073419 | A2 | 7/2006 |
| WO | 2007/038755 | A1 | 4/2007 |
| WO | 2007/050501 | A2 | 5/2007 |
| WO | 2007/053655 | A2 | 5/2007 |
| WO | 2008/028206 | A2 | 3/2008 |
| WO | 2008/106660 | A2 | 9/2008 |
| WO | 2009/100201 | A2 | 8/2009 |
| WO | 2010/040897 | A1 | 4/2010 |

OTHER PUBLICATIONS

"Nanodisc Assembly Kit MSP1E3D1_POPC" Cube Biotech, Dec. 2014, pp. 1-3.

"Nanodisc Formation" LIAO Lab, Department of Cellbiology, Harvard Medical School, http://liao.hms.harvard.edu/node/34; retrieved on Aug. 3, 2015.

"Nanodisc" Kobo eBook Library, http://www.kobolibrary.com/articles/Nanodisc, retrieved on Aug. 4, 2015, pp. 1-4.

"Nanodisc" Trademark #78166119, Owner: Sligar, Stephen G., https://inventively.com/search/trademarks/78166119; retrieved on Aug. 4, 2015.

"Protocols for Preparation of Nanodiscs" Mar. 4, 2008, pp. 1-7.

Abdulreda, M.H., et al., "Atomic Force Microscope Studies of the Fusion of Floating Lipid Bilayers." Biophys J 92, pp. 4369-4378, (2007).

Adamczyk et al., "The Isotope Array, a New Tool That Employs Substrate-Mediated Labeling of rRNA for Determination of Microbial Community Structure and Function" Appl. Environ. Microbiol.,69, pp. 6875-6887, (Nov. 2003).

Addison, et al., "Stable Isotope Probing: Technical Considerations When Resolving 15N-Labeled RNA in Gradients." J. Microbiol. Methods, 80, pp. 70-75, (2010).

Aranyi et al., "Predictable Difficulty or Difficulty to Predict" Protein Science, vol. 20, pp. 1-3, (2011).

Author Unknown (Calloway), Special Report, Dengue Fever Climbs the Social Ladder, Nature, vol. 448, pp. 734-735, (2007).

Baas, B.J., et al. "Homotropic Cooperativity of Monomeric Cytochrome P450 EA4 in a Nanoscale Native Bilayer Environment" Archives of Biochemistry and Biophysics 430, pp. 218-228, (2004).

Bacher et al., "Charge-Reduced Nano Electrospray Ionization Combined with Differential Mobility Analysis of Peptides, Proteins, Glycoproteins, Noncovalent Protein Complexes and Viruses", Journal of Mass Spectrometry 36: pp. 1038-1052, (2001).

Bacher, et al., "Negative and Positive Ion Matrix-Assisted Laser Desorption/Ionization Time-of-Flight Mass Spectrometry and Positive Ion Nano-Electrospray Ionization Quadrupole Ion Trap Mass Spectrometry of Peptidoglycan Fragments Isolated from Various *Bacillus* Species", J. Mass Spectrom. vol. 36, pp. 124-139, (2001).

Baker et al., "Hydrogen Production by a Hyperthermophilic Membrane-Bound Hydrogenase in Water Soluble Nanolipoprotein Particles", J. Amer. Chem. Soc., vol. 131, pp. 7508-7509, (2008).

Bao et al., "High-Sensitivity Detection of DNA Hybridization on Microarrays Using Resonance Light Scattering" Anal. Chem.,74, pp. 1792-1797, (2002).

Barros, F. et al., "Modulation of Human Erg K+ Channel Gating by Activation of a G Protein-Coupled Receptor and Protein Kinase C", J. Physiology, vol. 511.2, pp. 333-346, (1998).

Bayburt, T. H. et al., "Reconstitution and Imaging of a Membrane Protein in a Nanometer-Size Phospholipid Bilayer", J Struct Bio 123, pp. 37-44, (1998).

Bayburt, T. H. et al., "Self-Assembly of Single Integral Membrane Proteins into Soluble Nanoscale Phospholipid Bilayers." Protein Science 12, pp. 2476-2481, (2003).

Bayburt, T. H. et al., "Assembly of Single Bacteriorhodopsin Trimmers in Bilayer Nanodiscs" Archives of Biochemistry and Biophysics 450, pp. 215-222, (2006).

Bayburt, T. H. et al., "Single-Molecule Height Measurements on Microsomal Cytochrome P450 in Nanometer-Scale Phospholipid Bilayer Disks" Proc Natl Acad Sci USA 99, pp. 6725-6730, (2002).

Bayburt, T. H. et al., "Self-Assembly of Discoidal Phospholipid Bilayer Nanoparticles with Membrane Scaffold Proteins" Nano Lett. 2, No. 8, pp. 853-856, (2002).

Bayburt, T. H., et al.,"Transducin Activation by Nanoscale Lipid Bilayers Containing One and Two Rhodopsins", J Biol Chem, 282 (20), pp. 14875-14881, (2007).

Behrens et al., "Linking Microbial Phylogeny to Metabolic Activity at the Single-Cell Level by Using Enhanced Element Labeling-Catalyzed Reporter Deposition Fluorescence In Situ Hybridization

(56) References Cited

OTHER PUBLICATIONS (EL-FISH) and NanoSIMS", Applied and Environmental Microbiology 74, pp. 3143-3150 (May 2008).
Beja, O. et al., "Bacterial Rhodopsin: Evidence for a New Type of Phototrophy in the Sea". Science, 289, pp. 1902-1906, (2000).
Berthelot et al., "Rubber Elongation Factor (REF), a Major Allergen Component in Hevea Brasillensis Latex has Amyloid Properties" PLOS One (Epub Oct. 25, 2012) vol. 7, Issue 10, pp. 1-12, (2012).
Bijsterbosch, M.K., et al., "Specific Targeting of a Lilophilic Prodrug of Iododeoxyuridine to Parenchymal Liver Cells Using Lactosylated Reconstituted High Density Lipoprotein Particles." Biochemical Pharmacology, vol. 52, pp. 113-121, (1996).
Bischler, N. et al., "Specific Interaction and Two-Dimensional Crystallization of Histidine Tagged Yeast RNA Polymerase I on Nickel-Chelating Lipids" Biophysical Journal, vol. 74, pp. 1522-1532, (1998).
Blanchette CD, et al., "Quantifying Size Distributions of Nanolipoprotein Particles with Single-Particle Analysis and Molecular Dynamic Simulations" J Lipid Res., vol. 49, pp. 1420-1430, (2008).
Blanchette et al., "Atomic Force Microscopy Differentiates Discrete Size Distributions Between Membrane Protein Containing and Empty Nanolipoprotein Particles". accepted (BBA membranes) Biochim Biophys Acta 1788, pp. 724-731, (2009).
Blanchette, C.D., et al., "Characterization and Purification of Polydisperse Reconstituted Lipoproteins and Nanolipoprotein Particles". International Journal of Molecular Sciences, 10, pp. 2958-2971, (2009).
Bockaert J., et al., Do Recombinant Receptor Assays Provide Affinity and Potency. In Receptor Classification: The Integration of Operational, Structural, and Transductional Information (D.G. Trist, P.P.A. Humphrey, P. Leff, and N.P. Shankley, Eds.). vol. 812. New York, New York Academy of Sciences, pp. 55-70, (1997).
Boldog et al., "Using Nanodiscs to Create Water-Soluble Transmembrane Chemoreceptors Inserted in Lipid Bilayers", Methods in Enzymology, vol. 423, pp. 317-335 (2007).
Boldog, T. et al., "Nanodiscs Separate Chemoreceptor Oligomeric States and Reveal Their Signalling Properties", Proceedings of the National Academy of Sciences, vol. 103, No. 31, pp. 11509-11514, (2006).
Borch, J. et al., "Nanodiscs for Immobilization of Lipid Bilayers and Membrane Receptors: Kinetic Analysis of Cholera Toxin Binding to a Glycolipid Receptor". Analytical Chemistry, vol. 80, No. 16, pp. 6245-6252, (2008).
Boroske et al. "Osmotic Shrinkage of Giant Egg-Lecithin Vesicles" Biophys. J., vol. 34, pp. 95-109, (1981).
Boschker et al., "Direct Linking of Microbial Populations to Specific Biogeochemical Processes by 13C-Labelling of Biomarkers". Nature vol. 392, pp. 801-805, (1998).
Boschker, et al., "The Contribution of Macrophyte-Derived Organic Matter to Microbial Biomass in Salt-Marsh Sediments: Stable Carbon Isotope Analysis of Microbial Biomarkers", Limnol. Oceanogr., vol. 44(2) pp. 309-319, (1999).
Branden and Tooze, "Introduction to Protein Structure", 2nd Edition, Garland Science Publisher, pp. 3-12, (1999).
Brewer et al., "Formation of Thiolate and Phosphonate Adlayers on Indium -Tin Oxide: Optical and Electronic Characterization". Langmuir,18, pp. 6857-6865, (2002).
Brodie et al., "Profiling Microbial Identity and Activity: Novel Applications of NanoSIMS and High Density Microarrays", Systems Biology Research Strategy and Technology Development: Genomic and Proteomic Strategies, p. 137, (2008).
Brodie et al., "Application of a High-Density Oligonucleotide Microarray Approach to Study Bacterial Population Dynamics during Uranium Reduction and Reoxidation". Appl. Environ. Microbiol. vol. 72, No. 9, pp. 6288-6298, (2006).
Brodie et al., Systems Biology Research Strategy and Technology Development: Genomic and Proteomic Strategies. Publicly disclosed on Feb. 13, 2008, http://genomicscience.energy.gov/pubs/2008abstracts/2008GTLabstracts_tech.pdf.
Brodie et al., Urban Aerosols Harbor Diverse and Dynamic Bacterial Populations. Proceedings of the National Academy of Sciences vol. 104, No. 1, pp. 299-304, (2007).
Brown et al., "Exploring the New World of the Genome with DNA Microarrays" Nature Genetics, vol. 21, pp. 33-37, (1999).
Burgdorf et al., "The Soluble NAD+-Reducing [NiFe]-Hydrogenase from Ralstonia eutropha H16 Consists of Six Subunits and Can Be Specifically Activated by NADPH", Journal of Bacteriology, vol. 187, No. 9, pp. 3122-3132, (2005).
Camarero, J. A., et al. "Chemoselective Attachment of Biologically Active Proteins to Surfaces by Expressed Protein Ligation and its Application for "Protein Chip" Fabrication". J Am Chem Soc, vol. 126, pp. 14730-14731. (2004).
Cappuccio et al., "Cell-free Co-Expression of Functional Membrane Proteins and Apolipoprotein, Forming Soluble Nanolipoprotein Particles" J. Molecular and Cellular Proteomics 7.11, pp. 2246-2253, (2008).
Patrick J. Casey; M. C. Seabra, "Protein Prenyltransferases". Journal of Biological Chemistry vol. 271, No. 10, pp. 5289-5292, (1996).
Chaung, et al., "CpG oligodeoxynucleotides as DNA Adjuvants in Vertebrates and Their Applications in Immunotherapy", Int'l Immunopharmacology 6, pp. 1586-1596, (2006).
Chefson et al., "Progress Towards the Easier Use of P450 Enzymes", Mol. BioSyst., vol. 2, pp. 462-469, (2006).
Chen, et al., "Amino Acids in SRS1 and SRS6 are Critical for Furanocoumarin Metabolism by CYP6B1v1, a Cytochrome P450 Monooxygenase", Insect Mol. Biology vol. 11(2) pp. 175-186, (2002).
Chikh, et al., "Attaching Histidine-Tagged Peptides & Proteins to Lipid-Based Carriers Through Use of Metal-Ion-Chelating Lipids" BBA 1567, pp. 204-212, (2002).
Choquet et al. "Stability of Pressure-Extruded Liposomes Made from Archaeobacterial Ether Lipids" Appl. Microbiol. Biotechnol. ,42, pp. 375-384, (1994).
Chromy, B. A., et al., "Different Apolipoproteins Impact Nanolipoprotein Particle Formation", J Am Chem Soc., 129, pp. 14348-14354, (2007).
Civjan, N., et al., "Direct Solubilization of Heterologously Expressed Membrane Proteins by Incorporation Into Nanoscale Lipid Bilayers" Biotechniques, vol. 35, No. 3, pp. 556-563, (2003).
Cline et al., "Integration of Biological Networks and Gene Expression Data Using Cytoscape", Nat. Protocols vol. 2, No. 10, pp. 2366-2382, (2007).
Coleman, M., et al., Asp 46 Can Substitute Asp 96 as the Schiff Base Proton donor in bacteriorhodopsin. Biochemistry 34, pp. 15599-15606, (1995).
Cornish, "Biochemistry of Natural Rubber, a Vital Raw Material, Emphasizing Biosynthetic Rate, Molecular Weight and Compartmentalization, in Evolutionarily Divergent Plant Species" Nat. Prod. Rep., vol. 18, pp. 182-189, (2001).
Cornish et al. "Rubber Biosynthesis in Plants", American Oil Chemist Society, The Lipid Library, pp. 1-10, (Nov. 2011).
Cornish et al., "The Major Protein of Guayule Rubber Particles Is a Cytochrome P450", The Journal of Biological Chemistry, vol. 270, No. 15, pp. 8487-8494, Apr. 14, 1995.
Cornish K., et al., "Characterization of Cis-Prenyltransferase Activity Localized in a Buoyant Fraction of Rubber Particles from Ficus Elastica Latex". Plant Physiol. Biochem., vol. 34, No. 3, pp. 377-384, (1996).
Cornish, K., et al., "Natural Rubber Biosynthesis in Plants: Rubber Transferase." Methods in Enzymology, vol. 515, pp. 63-82, (2012).
Cracknell, J. A., et al., "Enzymatic Oxidation of H2 in Atmospheric 02: The Electrochemistry of Energy Generation from Trace H2 by Aerobic Microorganisms", Journal of the American Chemical Society, vol. 130, pp. 424-425, (2008).
Cruz, F., et al.,"Kinetic Properties of Recombinant MAO-A on Incorporation Into Phospholipid Nanodisks" J Neural Transm 114, pp. 699-702. (2007).
Cullis P.R. et al., Physical Properties and Functional Roles of Lipids in Membranes. In Biochemistry of Lipids, Lipoproteins, and Membranes (D.E. Vance and J. Vance, Eds.). vol. 20. New York: Elsevier, pp. 1-33, (1996).

(56) References Cited

OTHER PUBLICATIONS

Dalpke, A.H., et al., "Phosphodiester CpG Oligonucleotides As Adjuvants: Polyguanosine Runs Enhance Cellular Uptake and Improve Immunostimulative Activity of Phosphodiester CpG Oligonucleotides In Vitro and In Vivo". Immunology,106, pp. 102-112, (2002).
Das et al., "Hydrogen Production by Biological Processes: A Survey of Literature", International Journal of Hydrogen Energy, vol. 26, pp. 13-28, (2001).
Das et al., "Role of Fe-hydrogenase in Biological Hydrogen Production", Current Science 2006, vol. 90, No. 12, pp. 1627-1637, (2006).
Dawson P. et al., "Synthesis of Native Proteins by Chemical Ligation", Ann Rev Biochem 69, pp. 923-960, (2000).
DeSantis et al., "Greengenes, a Chimera-Checked 16S Rrna Gene Database and Workbench Compatible with ARB", Appl. Environ. Microbiol., vol. 72, No. 7, pp. 5069-5072 (2006).
DeSantis et al., "High-Density Universal 16S rRNA Microarray Analysis Reveals Broader Diversity than Typical Clone Library When Sampling the Environment". Microbial Ecology vol. 53, pp. 371-383, (2007).
Disalvo et al., "Surface Changes Induced by Osmotic Shrinkage on Large Unilamellar Vesicles" Chem. Phys. Lipids 84, pp. 35-45, (1996).
Dong, F. et al., "Endothelin-1 Enhances Oxidative Stress, Cell Proliferation and Reduces Apoptosis in Human Umbilical Vein Endothelial Cells: Role of ETB Receptor, NADPH Oxidase and Caveolin-1", British J. of Pharmacology, vol. 145, pp. 323-333. (2005).
Donniger, et al., "An Improved Synthesis of Isopentenyl Pyrophosphate", Biochem. J. 105, pp. 545-547, (1967).
Duan et al., "Co-Incorporation of Heterologously Expressed Arabidopsis Cytochrome P450 and P450 Reductase into Soluble Nanoscale Lipid Bilayers", Archives of Biochemistry and Biophysics 424, pp. 141-153, (2004).
Dubey et al., "Microencapsulation Technology and Applications", Defence Science Journal, vol. 59, No. 1, pp. 82-95 (2009).
Dumartin, B. et al. "Dopamine Tone Regulates D1 Receptor Trafficking and Delivery in Striatal Neurons in Dopamine Transporter-Deficient Mice", PNAS, vol. 97, No. 4, pp. 1879-1884, (2000).
Dunn, R. J., et al., "Structure-Function Studies on Bacteriorhodopsin. I. Expression of the Bacteriaopsin", Gene in *Escherichia coli*, J Biol Chem, vol. 262, No. 19, pp. 9246-9254, (1987).
Elgren, T. E. et al., "Immobilization of Active Hydrogenases by Encapsulation in Polymeric Porous Gels", Nano Letters, vol. 5, No. 10, pp. 2085-2087, (2005).
Fischer, N. et al., "Evaluation of Nanolipoprotein Particles (NLPs) as an In Vivo Delivery Platform", PLOS One, vol. 9, Issue 3, e93342, pp. 1-17, (Mar. 2014).
Fischer, N.O. et al., "Immobilization of His-tagged Proteins on Nickel-Chelating Nanolipoprotein Particles", Bioconjugate Chemistry 20, pp. 460-465, (2009).
Fitzgerald, K.A. et al., "The Shape of Things to Come", Science, vol. 316, pp. 1574-1576, (2007).
Forstner, M. et al., "Carboxyl-Terminal Domain of Human Apolipoprotein E: Expression, Purification, and Crystallization", Protein Expr Purif 17, pp. 267-272, (1999).
Forte, T. M., et al., "Electron Microscopic Study on Reassembly of Plasma High Density Apoprotein with Various Lipids". Biochim Biophys Acta, 248, pp. 381-386, (1971).
Frydman, J. et al., "Principles of Chaperone-Assisted Protein Folding: Differences Between In Vitro and In Vivo Mechanisms" Science 272, pp. 1497-1502, (1996).
Gan et al., "Role of NADPH-Cytochrome P450 Reductase and Cytochrome-b-5/NADH-b5 Reductase in Variability of CYP3A Activity in Human Liver Microsomes", Drug Metabolism and Disposition, vol. 37, No. 1, pp. 90-96, (2009).
Gantz, I. et al., Molecular Cloning of a Gene Encoding the Histamine H2 Receptor, PNAS, vol. 88, pp. 429-433, (1991).
Gardner, et al., "Systems for Orthogonal Self-Assembly of Electroactive Monolayers ONAU and ITO: An Approach to Molecular Electronics". JACS 117, pp. 6927-6933, (1995).
Giannini, S.L. et al., "Enhanced Humoral and Memory B Cellular Immunity Using HPV16/18 L1 VLP Vaccine Formulated with the MPL/Aluminium Salt Combination (AS04) Compared to Aluminium Salt Only". Vaccine 24, pp. 5937-5949, (2006).
Gilbert, L., "Insect Development: Morphognesis and Metamorphosis", Academic Press, pp. 573-574, (2009).
Goldet, G. et al., "Hydrogen Production under Aerobic Conditions by Membrane-Bound Hydrogenases from Ralstonia Species", Journal of the American Chemical Society, vol. 130, No. 33, pp. 11106-11113, (2008).
Gorrod, JW, et al., "Some observations on Type I and Type II microsomal binding spectra", Xenobiotica, vol. 1, Nos. 4/5, pp. 521-522, (1971).
Greve, Ullman's Encyclopedia of Industrial Chemistry, "Rubber,2. Natural", Wiley-VCH Verlag GmbH & Co., KGaA, Weinheim, DOI: 10.1002/14356007.a23_225, vol. 31 (2012), pp. 583-596.
Gronover C.S., et al., "Natural Rubber Biosynthesis and Physics—Chemical Studies on Plant Derived Latex, Biotechnology of Biopolymers" Magdy Elnashar (Ed.), ISBN:978-953-307-179-4, (2011).
Guo et al. "Protein Tolerance to Random Amino Acid Change", Proc. Natl. Acad. Sci. vol. 101, No. 25, pp. 9205-9210, (2004).
Gupta, R., et al., "Adjuvants for Human Vaccines—Current Status, Problems and Future Prospects", Vaccine vol. 13, No. 14, pp. 1263-1276, (1995).
Gursky, O., et al., "Complex of Human Apolipoprotein C-1 with Phospholipid: Thermodynamic or Kinetic Stability?" Biochemistry 41, pp. 7373-7384, (2002).
Hallenbeck et al., "Biological Hydrogen Production: Fundamentals and Limiting Processes", International Journal of Hydrogen Energy 27, pp. 1185-1193, (2002).
Hamdy, S., et al., "Pharmaceutical Analysis of Synthetic Lipid A-Based Vaccine Adjuvants in Poly (d,l-lactic-co-glycolic acid) Nanoparticle Formulations", Journal of Pharmaceutical and Biomedical Analysis 44, pp. 914-923, (2007).
Hasemann et al., "Structure and Function of Cytochromes P450: A Comparative Analysis of Three Crystal Structures", Structure vol. 3, No. 1, pp. 41-62, (1995).
Hedderich, R., "Energy-Converting [NiFe] Hydrogenases From Archaea and Extromohiles: Ancestors of Complex I", Journal of Bioenergetics and Biomembranes, vol. 36, No. 1, pp. 65-75, (2004).
Hernéndez-Caselles et al., "Influence of Liposome Charge and Composition on their Interaction With Human Blood Serum Proteins" Mol. Cell. Biochemistry 120, pp. 119-126, (1993).
Hill et al., "Functional Analysis of Conserved Histidines in ADP-Glucose Pyrophosphorylase from *Escherichia coli*", Biochem. Biophys, Res. Comm. vol. 244, pp. 573-577, (1998).
Hiraishi, et al., "Enzyme-Catalyzed Synthesis and Degradation of Biopolymers" Mini-Reviews in Organic Chemistry, Bentham Science Publishers vol. 6, No. 1, pp. 44-54, (2009).
Ho, D. et al., "Fabrication of Biomolecule-Copolymer Hybrid Nanovesicles as Energy Conversion Systems", Nanotechnology 16, pp. 3120-3132, (2005).
Hong, Y. et al., "G-Protein-Coupled Receptor Microarrays for Multiplexed Compound Screening" J. Biomol. Screening, vol. 11(4), pp. 435-438, (2006).
Huleatt, J.W., et al., "Potent Immunogenicity and Efficacy of a Universal Influenza Vaccine Candidate Comprising a Recombinant Fusion Protein Linking Influenza M2e to the TLR5 Ligand Flagellin", Vaccine 26, pp. 201-214, (2008).
Ishihara, G. et al., "Expression of G Protein Coupled Receptors in a Cell-Free Translational System Using Detergents and Thioredoxin-Fusion Vectors", Protein Expr Purif 41, pp. 27-37, (2005).
Jasanada et al., "Indium-111 Labeling of Low Density Lipoproteins with the DTPA-BIS(Stearylamide): Evaluation as a potential Radiopharmaceutical for Tumor Localization", Bioconj. Chem. 7, No. 1, pp. 72-81, (1996).
Jayaraman, S., et al., "Structural Basis for Thermal Stability of Human Low-Density Lipoprotein", Biochemistry 44, pp. 3965-3971, (2005).

(56) References Cited

OTHER PUBLICATIONS

Jonas, A et al. "Defined Apolipoprotein A-I Conformations in Reconstituted High Density Lipoprotein Discs", J Biol Chem, vol. 264, No. 9, pp. 4818-4824, (1989).
Jonas, A., "Reconstitution of High-Density Lipoproteins Methods", Enzymol., vol. 128, pp. 553-582, (1986).
Jones, M. et al., "Computer Programs to Identify and Classify Amphipathic Helical Domains" Journal of Lipid Research, vol. 33, pp. 287-296, (1992).
Kalmbach, R., et al., "Functional Cell-Free Synthesis of a Seven Helix Membrane Protein: In Situ Insertion of Bacteriorhodopsin into Liposomes", J Mol Bio 371, pp. 639-648, (2007).
Kapdan et al., "Bio-Hydrogen Production from Waste Materials", Enzyme and Microbial Technology, 38, pp. 569-582, (2006).
Katzen et al., "Insertion of Membrane Proteins into Discoidal Membranes using a Cell-Free Protein Expression Approach", J. Proteome Res. vol. 7, pp. 3536-3542, (2008).
Kim et al., "Gold Nanoparticle-Enhanced Secondary Ion Mass Spectrometry Imaging of Peptides on Self-Assembled Monolayers", Anal. Chem., vol. 78, No. 6, pp. 1913-1920, (2006).
Klammt, C et al., "Evaluation of Detergents for the Soluble Expression of Alpha-Helical and Beta-Barrel-Type Integral Membrane Proteins by a Preparative Scale Individual Cellfree Expression System", Febs J 272, pp. 6024-6038, (2005).
Klammt, C. et al., "High Level Cell-Free Expression and Specific Labeling of Integral Membrane Proteins" Eur J Biochem. 271, pp. 568-580, (2004).
Klammt, C., et al., "Cell-Free Expression as an Emerging Technique for the Large Scale Production of Integral Membrane Protein", Febs J 273, pp. 4141-4153, (2006).
Kolb et al., "The Growing Impact of Click Chemistry on Drug Discovery", Drug Discovery Today, vol. 8, No. 24, pp. 1128-1137, (2003).
Konigsberg et al., "Chemical Modification of Hemoglobins: A Study of Conformation Restraint by Internal Bridging", Proc Natl Acad Sci., vol. 56, pp. 749-756, (1966).
Konishi, E. et al., "Proper Maturation of the Japanese Encephalitis Virus Envelope Glycoprotein Requires Cosynthesis with the Premembrane Protein", J Virol, vol. 67, No. 3, pp. 1672-1675, (1993).
Kostarelos et al., "Steric Stabilization of Phospholipid Vesicles by Block Copolymers" Vesicle Flocculation and Osmotic Swelling Caused by Monovalent and Divalent Cations, J. Chem. Soc., Faraday Trans., vol. 94(15), pp. 2159-2168, (1998).
Kovacs, K. L. et al., "A Novel Approach for Biohydrogen Production", International Journal of Hydrogen Energy 31, pp. 1460-1468, (2006).
Kubalek, E.W. et al., "Two-Dimensional Crystallization of Histidine-Tagged, HIV-1 Reverse Transcriptase Promoted by a Novel Nickel-Chelating Lipid", Journal of Structural Biology, vol. 113, pp. 117-123, (1994).
Kurkin et al., "The Membrane-Bound [NiFe]-Hydrogenase (Ech) from Methanosarcina Barkeri; Unusual Properties of the Iron-Sulphur Clusters", Eur. J. Biochem. 269, pp. 6101-6111, (2002).
Lam, K. S. et al., "Application of Combinatorial Library Methods in Cancer Research and Drug Discovery", Anti-cancer Drug Design, vol. 12, pp. 145-167, (1997).
Lasic et al., "Novel Applications of Liposomes" Trends Biotechnology, vol. 16, pp. 307-321, (1998).
Lazar et al., Transforming Growth Factor a: Mutation of Aspartic Acid 47 and Leucine 48 Results in Different Biological Activities, Mol. Cell. Biol., vol. 8, No. 3, pp. 1247-1252, (1988).
Lechene et al., "High-Resolution Quantitative Imaging of Mammalian and Bacterial Cells Using Stable Isotope Mass Spectrometry", Journal of Biology, vol. 5, Article 20, 30 pages, (2006).
Lee et al., "Ab Initio Protein Structure Prediction" From Protein Structure to Function with Bioinformatics, Springer Science + Business Media B.V., pp. 1-23, (2009).
Leitz, A. J., et al., "Functional Reconstitution of Beta2-Adrenergic Receptors Utilizing Selfassembling Nanodisc Technology" Biotechniques, vol. 40, No. 5, pp. 601-612, (2006).
Liang et al., "Mechanical Properties and Stability Measurement of Cholesterol-Containing Liposome on Mica by Atomic Force Microscopy", J. Colloid Interface Science 278, pp. 53-62, (2004).
Lluis et al., "Protein Engineering Methods Applied to Membrane Protein Targets", vol. 26, No. 2, pp. 91-100, (2013).
Lodish, H., et al., "Section 17.5 Insertion of Membrane Proteins into the ER membrane", Molecular Cell Biology 4th edition, New York, NY., 9 pages, (2000).
Long et al., "Characterization of a HoxEFUYH type of [NiFe] Hydrogenase from Allochromatium Vinosum and some EPR and IR Properties of the Hydrogenase Module", J. Biol. Inorg. Chem., vol. 12, pp. 62-78, (2007).
Lu, B., et al., "Conformational Reorganization of the Four-Helix Bundle of Human Apolipoprotein E in Binding to Phospholipid", J Biol Chemistry vol. 275, No. 27, pp. 20775-20781, (2000).
Ludwig et al., "ARB: a software environment for sequence data". Nucleic Acids Research, vol. 32, No. 4, pp. 1363-1371, (2004).
Manefield, A. S. et al., "RNA Stable Isotope Probing, a Novel Means of Linking Microbial Community Function to Phylogeny", Appl. Environ. Microbiol., vol. 68, No. 11, pp. 5367-5373, (2002).
Martin, B.R. et al., "Large-Scale Profiling of Protein Palmitoylation in Mammalian Cells", Nature Methods, vol. 6, No. 2, pp. 135-138, (2009).
Masquelier M. et al., "Low-Density Lipoprotein as a Carries of Antitumoral Drugs: In Vivo Fate of Drug-Human Low-Density Lipoprotein Complexes in Mice", Cancer Research, American Association for Cancer Research, vol. 46, No. 1, pp. 3842-3847, (1986).
Mata-Haro, V., et al., "The Vaccine Adjuvant Monophosphoryl Lipid A as a TRIF-Biased Agonist of TLR4", Science, vol. 316, pp. 1628-1632, (2007).
McGall et al., "The Efficiency of Light-Directed Synthesis of DNA Arrays on Glass Substrates", J. Amer. Che. Soc., vol. 119, No. 22, pp. 5081-5090, (1997).
McIntosh et al., "The [NiFe]-Hydrogenase of the *Cyanobacterium synechocystis* sp. PCC 6803 Works Bidirectionally with a Bias to H2 Production", Journal of the American Chemical Society, 133, pp. 11308-11319, (2011).
McTernan et al., "Intact Functional Fourteen-subunit Respiratory Membrane-bound [NiFe]-Hydrogenase Complex of the Hyperthermophilic Archaeon Pyrococcus furiosus", The Journal of Biological Chemistry, vol. 289, No. 28, pp. 19364-19372 (2014).
Metz, J. et al., "ACTH, a-MSH, and Control of Cortisol Release: Cloning, Sequencing, and Functional Expression of the Melanocortin-2 and Melanocortin-5 Receptor in Cyprinus Carpio", Am. J. Physiol. Regul. Integr. Comp. Physiol., vol. 289, pp. R814-R826, (2005).
Meuer et al., "Purification and Catalytic Properties of Ech Hydrogenase from Methanosarcina Barkeri", Eur. J. Biochem., 265, pp. 325-335, (1999).
Meyer. J., "Fe/Fe Hydrogenases and their Evolution: A Genomic Perspective", Cell. Mol. Life. Science, vol. 64, pp. 1063-1084, (2007).
Morrow, J. A., et al., "Functional Characterization of Apolipoprotein E Isoforms Overexpressed in *Escherichia coli*", Protein Expr Purification 16, pp. 224-230, (1999).
Moses et al., "Detection of DNA Hybridization on Indium Tin Oxide Surfaces", Sensors and Actuators B 125, pp. 574-580, (2007).
Nath, A, et al., "Applications of Phospholipid Bilayer Nanodiscs in the Study of Membranes and Membrane Proteins", Biochemistry, vol. 46, No. 8, pp. 2059-2069, (2007).
North et al., "Alteration of Synaptic Membrane Cholestorl/Phosphol Ratio Using a Lipid Transfer Protein", J. Biol. Chem. vol. 258, No. 2. pp. 1242-1253, (1983).
Ohya, N. et al., "Biosynthesis of Natural Rubber and Other Natural Polyisoprenoids", Biopolymers Polyisoprenoids. 2.1 pp. 73-81,.
Okemoto, K., et al., "A Potent Adjuvant Monophosphoryl Lipid A Triggers Various Immune Responses, but Not Secretion of IL-β or Activation of Caspase-1", The Journal of Immunology, 176, pp. 1203-1208, (2006).

(56) References Cited

OTHER PUBLICATIONS

Osada et al., "Polymorphonuclear Leukocyte Activation by a Synthetic Muramyl Dipeptide Analog", Inf. Immunity, vol. 38, No. 3, pp. 848-854, (1982).
Ouverney, C.C. and J. A. Fuhrman, "Combined Microautoradiography-16S rRNA Probe Technique for Determination of Radioisotope Uptake by Specific Microbial Cell Types in Situ" Appl. Environ. Microbiology, vol. 65, No. 4, pp. 1746-1752, (Apr. 1999).
Pan, et al., "The Major Protein of Guayule Rubber Particles Is a Cytochrome P450",The Journal of Biological Chemistry, vol. 270, No. 15, pp. 8487-8494, (1995).
Parkin, A., et al., "The Difference a Se Makes?" Am Chem. Soc., vol. 130, No. 40, pp. 13410-13416, (2008).
Pasini E.M. et al., "In-Depth Analysis of the Membranes and Cytosolic Proteome of Red Blood Cells" Blood, vol. 108, No. 3, pp. 791-801, (2006).
Patel J et al., "Preparation and Characterization of Nickel Nanoparticles for Binding to His-tag Proteins and Antigens", Pharma. Res., vol. 24, No. 2, pp. 343-352, (2007).
Paterson-Jones, et al., "The Biosynthesis of Natural Rubber", Journal of Plant Physiology, vol. 136, Issue 3, pp. 257-263, (1990).
International Preliminary Report on Patentability for International Application No. PCT/US2008/063307 filed May 9, 2008. Dated Nov. 10, 2009.
International Search Report for International Application No. PCT/US2008/063307 filed May 9, 2008. Dated Oct. 29, 2008.
Written Opinion for International Application No. PCT/US2008/063307 filed on May 9, 2008. Dated Oct. 29, 2008.
International Preliminary Report on Patentability for International Application No. PCT/US2009/033193 filed on Feb. 5, 2009. Dated Aug. 10, 2010.
International Search Report for International Application No. PCT/US2009/033193 filed on Feb. 5, 2009. Dated Sep. 30, 2009.
Written Opinion for International Application No. PCT/US2009/033193 filed on Feb. 5, 2009. Dated Sep. 30, 2009.
International Preliminary Report on Patentability for International Application No. PCT/US2009/044722 filed on May 20, 2009. Dated Nov. 23, 2010.
International Search Report for International Application No. PCT/US2009/044722 filed on May 20, 2009. Dated Oct. 28, 2010.
Written Opinion for International Application No. PCT/US2009/044722 filed on May 20, 2009. Dated Oct. 28, 2010.
International Search Report for International Application No. PCT/US2015/051172 filed on Sep. 21, 2015. Dated Jan. 7, 2016.
Written Opinion for International Application No. PCT/US2015/051172 filed on Sep. 21, 2015. Dated Jan. 7, 2016.
International Search Report and Written Opinion for International Application No. PCT/US2015/051516 filed Sep. 22, 2015. Dated Jan. 25, 2016. 14 pages.
Persing, D., et al., "Taking Toll: Lipid A Mimetics as Adjuvants and Immunomodulators", Trends in Microbiology, vol. 10, No. 10 (suppl.), pp. S32-S37, (2002).
Persson, et al., "Topology Prediction of Membrane Proteins", Protein Science, 5, pp. 363-371, (1996).
Peters-Libeau et al., "Model of Biologically Active Apolipoprotein E Bound to Dipalmitoylphosphatidylcholine", The Journal of Biological Chemistry vol. 281, No. 2, pp. 1073-1079, (2006).
Petrakova, O., et al.,"Noncytopathic Replication of Venezuelan Equine Encephalitis Virus and Eastern Equine Encephalitis Virus Replicons in Mammalian Cells", J Virol, vol. 79, No. 12, pp. 7597-7608, (2005).
Pettibone, D., et al., "The Effects of Deleting the Mouse Neurotensin Receptor NTR1 on Central and Peripheral Responses to Neurotensin", J. Pharma. & Exp. Therapeutics, vol. 300, No. 1, pp. 305-313, (2002).
Ponciano et al. "Transcriptome and Gene Expression Analysis in Cold-Acclimated Guayule (*Parthenium argentum*) Rubber-Producing Tissue", Phytochemistry, vol. 79, pp. 57-66, (2012).
Radajewski S., et al., "Identification of Active Methylotroph Populations in an Acidic Forest Soil by Stable Isotope Probing", Microbioly, 148, pp. 2331-2342, (2002).
Radajewski, et al., "Stable-Isotope Probing as a Tool in Microbial Ecology", Nature, vol. 403, pp. 646-649, (2000).
Rakhely et al., "Cyanobacterial-Type, Heteropentameric, NAD+-Reducing NiFe Hydrogenase in the Purple Sulfur Photosynthetic Bacterium Thiocapsa roseopersicina", Applied and Environmental Microbiology,vol. 70, No. 2, pp. 722-728, (2004).
Rao, R. S., et al., Comparison of Multiplexed Techniques for Detection of Bacterial and Viral Proteins. J Proteome Research vol. 3, No. 4 pp. 736-742, (2004).
Ratanabanangkoon, P. et al., "Two-Dimensional Streptavidin Crystals on Giant Lipid Bilayer Vesicles", Langmuir, vol. 18, pp. 4270-4276, (2002).
Ren, X., et al., Different G Protein-Coupled Receptor Kinases Govern G Protein and B-Arrestin-Mediated Signaling of V2 Vasopressin Receptor, PNAS, vol. 102, No. 5, pp. 1448-1453, (2005).
Rensen, et al., "Recombinant Lipoproteins: Lipoprotein-like Lipid particles for drug targeting." Adv. Drug Delivery Rev. Elsevier BV, Amsterdam, vol. 47, Issues 2-3, pp. 251-276, (2001).
Ruger, et al., "Generation of Immunoliposomes Using Recombinant Single-Chain Fv Fragments Bound to Ni-NTA-Liposomes", J. Drug Targeting, vol. 13, No. 7, pp. 399-406, (2005).
Ruger, R. et al., "In vitro Characterization of Binding and Stability of Single-Chain Fv Ni-NTA-Liposomes", J. Drug Targeting, vol. 14, No. 8, pp. 576-582, (2006).
Rusinol et al., "In Vitro Reconstitution of Assembly of Apolipoprotein B48-containing Lipoproteins", Journal of Biological Chemistry vol. 272, No. 12, pp. 8019-8025, (1997).
Sanderson, K., "The Photon Trap" Nature, vol. 452, pp. 400-402, (2008).
Sapra, R. et al., "A Simple Energy-Conserving System: Proton Reduction Coupled to Proton Translocation", Proceedings of the National Academy of Sciences, vol. 100, No. 13, pp. 7545-7550, (2003).
Sapra, R. et al., Purification and Characterization of a Membrane-Bound Hydrogenase from the Hyperthermophilic Archeon . . . Journal of Bacteriology, vol. 182, No. 12, pp. 3423-3428, (2000).
Sawasaki, T et al. "A Bilayer Cell-Free Protein Synthesis System for High-Throughput Screening of Gene Products" FEBS Lett 514, (2002) pp. 102-105.
Schena et al., "Quantitative Monitoring of Gene Expression Patterns with a Complementary DNA Microarray" Science, vol. 270, Issue 5235, pp. 467-470, (1995).
Schmidt et al., "Characterization of Rubber Particles and Rubber Chain Elongation in Taraxacum Koksaghyz.", BMC Biochemistry, vol. 11, pp. 1-11, (2010).
Schmitt et al., "Synthesis and Characterization of Chelator-Lipids for Reversible Immobilization of Engineered Proteins at Self Assembled Lipid Interfaces", J. Am. Chem. Society, vol. 116, No. 19, pp. 8485-8491, (1994).
Schmitz et al., "HoxE—a Subunit Specific for the Pentameric Bidirectional Hydrogenase Complex (HoxEFUYH) of Cyanobacteria", Biochimica et Biophysica Acta, 1554, 66-74 (2002).
Schnell DJ et al., "Protein Translocons: Multifunctional Review Mediators of Protein Translocation across Membranes", Cell, vol. 112, pp. 491-505, (2003).
Segelke, B. W. et al., "Laboratory Scale Structural Genomics", J Struct Funct Genomics, vol. 5, pp. 147-157, (2004).
Shaw, A. W.al., et "Phospholipid Phase Transitions in Homogeneous Nanometer Scale Bilayer Discs" FEBS Lett 556, pp. 260-264, (2004).
Shih, A. et al., "Molecular Dynamics Simulations of Discoidal Bilayers Assembled from Truncated Human Lipoproteins", Biophysical J., vol. 88, pp. 548-556, (2005).
Siler et al., "Composition of Rubber Particles of Hevea Brasiliensis, Parthenium Argentatum, Ficus Elastics and Euphorbia Lactiflua Indicates Unconventional Surface Structure", Plant Physiol. Biochem. vol. 35, No. 11, pp. 881-889, (1997).

(56) References Cited

OTHER PUBLICATIONS

Singh et al., "The Micromorphology and Protein Characterization of Rubber Particles in Ficus Carica, Ficus Benghalensis and Hevea Brasiliensis", Journal of Experimental Botany vol. 54, No. 384, pp. 985-992, (2003).
Singh-Gasson et al., "Maskless Fabrication of Light-Directed Oligonucleotide Microarrays Using a Digital Micromirror array", Nat. Biotech., vol. 17, 974-978, (1999).
Soboh et al., "A Multisubunit Membrane-Bound [NiFe] Hydrogenase and an NADH-Dependent Fe-only Hydrogenase in the Fermenting Bacterium Thermoanaerobacter tengcongenis", Microbiology, vol. 150, pp. 2451-2463 (2004).
Soboh et al., "Purification and Catalytic Properties of a CO-Oxidizing: H2-Evolving Enzyme Complex from Carboxydothermus Hydrogenoformans", Eur. J. Biochem., vol. 269, pp. 5712-5721, (2002).
Sonar, S., et al., "Cell-Free Synthesis, Functional Refolding, and Spectroscopic Characterization of Bacteriorhodopsin, an Integral Membrane Protein", Biochemistry, vol. 32, pp. 13777-13781, (1993).
Sonar, S., et al., "A Redirected Proton Pathway in the Bacteriorhodopsin Mutant Tyr-57-->Asp.", Evidence for Proton Translocation Without Schiff Base Deprotonation, J Biol Chem, vol. 269, pp. 28851-2885, (1994).
Sperling, et al., "Surface Modification, Functionalization and Bioconjugation of Colloidal Inorganic Nanoparticles". Phil. Trans. R. Soc. A, vol. 368, pp. 1333-1383, (2010).
Stadermann, et al., "Nanosims: The Next Generation Ion Probe for the Microanalysis of Extra Terrestrial Material", Meteoritics & Planetary Science, vol. 34, No. 4, Supplement, pp. A111-A1112, (1999).
Stryer, "Lipid Vesicles (Liposomes) and Planar Membranes Are Valuable Model Systems", Biochemistry, 4th Ed. W.H. Freeman and Company, New York, pp. 271, (1995).
Sun et al., "Overview of Protein Structural and Functional Folds", Current Protocols in Protein Science, vol. 35, pp. 17.1.58-17.1.59, (2004).
Sun, X. et al., "Membrane-Mimetic Films of Aymmetric Phosphtidylcholine Lipid Bolaamphiphiles", Langmuir, vol. 22, pp. 1201-1208, (2006).
Terpe, "Overview of Tag Protein Fusions: From Molecular and Biochemical Fundamentals to Commercial Systems", Appl Microbiol Biotechnol, vol. 60, pp. 523-533, (2003).
Tufteland, M. et al., "Peptide Stabilized Amphotericin B Nanodisks", Peptides 28, pp. 741-746, (2007).
Ueda, et al., "Induction of Tumor Necrosis Factor-a in Solid Tumor Region by the Orally Administered Synthetic Muramyl Dipeptide Analogue, Romurtide", Int'l Immunopharmacology 1, pp. 97-104, (2001).
Uhlík, et al., "DNA-Based Stable Isotope Probing: A Link Between Community Structure and Function", Sci. Total Environ. 407, pp. 3611-3619, (2009).
Ulmer, et al., "Vaccine Manufacturing: Challenges and Solutions", Nature Biotechnology, vol. 24, No. 11, pp. 1377-1383, (2006).
Unger et al., "The Genetic Algorithm Approach to Protein Structure Prediction", Structure and Bonding, vol. 110, pp. 153-175, (2004).
Vignais, P.M., et al., "Occurrence, Classification and Biological Function of Hydrogenases: An Overview", Chem. Rev., vol. 107, No. 10, pp. 4206-4272, (2007).
Vincent, K. A. et al., "Investigating and Exploiting the Electrocatalytic Properties of Hydrogenases", Chem. Rev., vol. 107, pp. 4366-4413, (2007).
Vincent, K.A., et al., "Electrocatalytic Hydrogen Oxidation by an Enzyme at High Carbon Monoxide or Oxygen Levels", vol. 102, No. 47, pp. 16951-16954, (2005).
Vuorilehto et al., "Indirect Electrochemical Reduction of Nicotinamide Coenzymes", Bioelectrochemistry, vol. 65, pp. 1-7, (2004).
Wacey et al., "Disentangling the Perturbational Effects of Amino Acid Substitutions in the DNA-Binding Domain of p53", Hum. Genet, vol. 104, pp. 15-22, (1999).
Wallin, E., et al., "Genome-Wide Analysis of Integral Membrane Proteins from Eubacterial, Archaean, and Eukaryotic Organisms", Protein Sci. vol. 7, pp. 1029-1038, (1998).
Walter et al. "Preparation of Microsomal Membranes for Cotranslational Protein Translocation", Methods Enzymology, vol. 96, pp. 84-93, (1983).
Wang, et al., "Comparison of the Dynamics of the Primary Events of Bacteriorhodopsin in its Trimeric and Monomeric States", Biophys. J., vol. 83, pp. 1557-1566, (2002).
Weeratna, R.D., et al., "CpG DNA Induces Stronger Immune Responses with Less Toxicity Than Other Adjuvants", Vaccine 18, pp. 1755-1762, (2000).
Wetterau et al., "Effect of Dipalmitoylphosphatidylcholine Vesicle Curvature on the Reaction with Human Apolipoprotein A-I", The Journal of Biological Chemistry, vol. 257, No. 18, pp. 10961-10966, (1982).
Whalen et al "Development of Crops to Produce Industrially Useful Natural Rubber" in Isoprenoid Synthesis in Plants and Microorganisms: New Concepts 329 and Experimental Approaches, Springer Science+Business Media New York, Chapter 23, pp. 329-345, (2013).
White, SH, et al., "How Translocons Select Transmembrane Helices", Annu. Rev. Biophys. vol. 37, pp. 23-42, (2008).
Whorton M. et al., "A monomeric G Protein-Coupled Receptor Isolated in a High-Density Lipoprotein Particle Efficiently Activates its G Protein", Proc Natl Acad Sci., vol. 104, No. 18, pp. 7682-7687, (2007).
Widman, D. G., et al., "Construction and Characterization of a Second-Generation Pseudoinfectious West Nile Virus Vaccine Propagated Using a New Cultivation System", Vaccine, vol. 26, pp. 2762-2771, (2008).
Wientzek, M., et al., "Binding of Insect Apolipophorin III to Dimyristoylphosphatidylcholine Vesicles", Evidence for a Conformational Change., J Biol Chem, vol. 269, No. 6, pp. 4605-4612 (1994).
Wikipedia—Bacteriorhodopsin (Downloaded from the internet on Jun. 22, 2015). 2 pages.
Wikipedia. 5-HT Receptor, Wikipedia 2007, http://web.archive.org/web/20071109235348/http://en.wikipedia.org/wiki/5-HT_receptor.
Wikipedia. Adrenergic Receptor, Wikipedia 2006, http://web.archive.org/web/20061230132111/http://en.wikipedia.org/wiki/Adrenergic_Receptor.
Wikipedia. G Protein-coupled Receptor, Wikipedia 2008, http://web.archive.org/web/20080224232212/http://en.wikipedia.org/wiki/G_protein-coupled_receptor.
Wikipedia. Hydrogenase retrieved from en.wikipedia.org/wiki/Hydrogenase on Nov. 6, 2012, pps. 1-4.
Wikipedia. Muscarinic Acetylcholine Receptor, Wikipedia 2007, http://web.archive.org/web/20071020193657/http://en.wikipedia.org/wiki/Muscarinic_acetylcholine_receptor.
Woodward, J., et al., "Enzymatic Production of Biohydrogen", Nature, vol. 405, pp. 1014-1015, (2000).
Woodward, J. et al., "In Vitro Hydrogen Production by Glucose Dehydrogenase and Hydrogenase", Nature Biotechnology, vol. 14, pp. 872-874, (1996).
Wu, J. et al., "High Yield Cell-Free Production of Integral Membrane Proteins Without Refolding or Detergents", Biochimica et Biophysica Acta 1778, pp. 1237-1250, (2008).
Xie, W., et al., "Initiation of Rubber Biosynthesis: In Vitro Comparisons of Benzophenone-Modified Diphosphate Analogues in Three Rubber-Producing Species", Phytochemistry 69, pp. 2539-2545, (2008).
Yoon et al., "Three-Dimensional Graphene Nano-Networks with High Quality and Mass Production Capability via Precursor-Assisted Chemical Vapor Deposition", Scientific Reports, 3:1788, pp. 1-8, (2013).
Zhang, P.Y-H., et al., "High-Yield Hydrogen Production from Starch and Water by a Synthetic Enzymatic Pathway", PLoS One, Issue 5, e456, (2007).
Zhanhua et al., "Protein Subunit Interfaces: Heterodimers Versus Homodimers", Bioinformation, 1 (2), pp. 28-39, (2005).

(56) References Cited

OTHER PUBLICATIONS

Zhiqiang, P. et al. "The Major Protein of Guayule Rubber Particles Is a Cytrochrome P450", The Journal of Biological Chemistry, vol. 270, No. 15, pp. 8487-8494, (1995).
Zimmermann, et al., "Immunostimulatory DNA as Adjuvant: Efficacy of Phosphodiester CpG Oligonucleotides is Enhanced by 3' Sequence Modifications", Vaccine 21, pp. 990-995, (2003).
Restriction Requirement for U.S. Appl. No. 14/199,973, filed Mar. 6, 2014 on behalf of Paul D. Hoeprich. Dated Dec. 8, 2014. 7 pages.
Non-Final Office Action for U.S. Appl. No. 14/199,973, filed Mar. 6, 2014 on behalf of Paul D. Hoeprich. Dated May 6, 2015. 19 pages.
Notice of Allowance for U.S. Appl. No. 14/199,973, filed Mar. 6, 2014 on behalf of Paul D. Hoeprich. Dated Dec. 10, 2015. 11 pages.
Restriction Requirement for U.S. Appl. No. 12/118,530, filed May 9, 2008 on behalf of Mathew A. Coleman. Dated Sep. 24, 2010. 12 pages.
Restriction Requirement for U.S. Appl. No. 12/118,530, filed May 9, 2008 on behalf of Mathew A. Coleman. Dated Mar. 30, 2011. 28 pages.
Non-Final Office Action for U.S. Appl. No. 12/118,530, filed May 9, 2008 on behalf of Mathew A. Coleman. Dated Aug. 30, 2011. 22 pages.
Final Office Action for U.S. Appl. No. 12/118,530, filed May 9, 2008 on behalf of Mathew A. Coleman. Dated Jan. 25, 2012. 37 pages.
Advisory Action for U.S. Appl. No. 12/118,530, filed May 9, 2008 on behalf of Mathew A. Coleman. Dated Jun. 6, 2012. 4 pages.
Non-Final Office Action for U.S. Appl. No. 12/118,530, filed May 9, 2008 on behalf of Mathew A. Coleman. Dated Jul. 24, 2014. 30 pages.
Final Office Action for U.S. Appl. No. 12/118,530, filed May 9, 2008 on behalf of Mathew A. Coleman. Dated Mar. 6, 2015. 51 pages.
Advisory Action & Non-Compliant Amendment Notice for U.S. Appl. No. 12/118,530, filed May 9, 2008 on behalf of Mathew A. Coleman. Notification Date: Jul. 23, 2015. 8 pages.
Restriction Requirement for U.S. Appl. No. 12/118,396, filed May 9, 2008 on behalf of Mathew A. Coleman. Dated Mar. 4, 2011. 14 pages.
Non-Final Office Action for U.S. Appl. No. 12/118,396, filed May 9, 2008 on behalf of Mathew A. Coleman. Dated Aug. 30, 2011. 12 pages.
Final Office Action for U.S. Appl. No. 12/118,396, filed May 9, 2008 on behalf of Mathew A. Coleman. Dated Jan. 18, 2012. 16 pages.
Advisory Action for U.S. Appl. No. 12/118,396, filed May 9, 2008 on behalf of Mathew A. Coleman. Dated Jun. 7, 2012. 4 pages.
Non-Final Office Action for U.S. Appl. No. 12/118,396, filed May 9, 2008 on behalf of Mathew A. Coleman. Dated Jul. 22, 2014. 24 pages.
Final Office Action for U.S. Appl. No. 12/118,396, filed May 9, 2008 on behalf of Mathew A. Coleman. Dated Feb. 4, 2015. 29 pages.
Advisory Action for U.S. Appl. No. 12/118,396, filed May 9, 2008 on behalf of Mathew A. Coleman. Dated Jul. 7, 2015. 6 pages.
Non-Final Office Action for U.S. Appl. No. 12/118,396, filed May 9, 2008 on behalf of Mathew A. Coleman. Dated Jan. 8, 2016. 25 pages.
Final Office Action for U.S. Appl. No. 12/118,396, filed May 9, 2008 on behalf of Mathew A. Coleman. Dated Oct. 11, 2016. 29 pages.
Restriction Requirement for U.S. Appl. No. 12/352,548, filed Jan. 12, 2009 on behalf of Brett A. Chromy. Dated Apr. 25, 2011. 6 pages.
Non-Final Office Action for U.S. Appl. No. 12/352,548, filed Jan. 12, 2009 on behalf of Brett A. Chromy. Dated Sep. 13, 2011. 7 pages.
Notice of Allowance for U.S. Appl. No. 12/352,548, filed Jan. 12, 2009 on behalf of Brett A. Chromy. Dated Mar. 12, 2012. 5 pages.
Notice of Allowance for U.S. Appl. No. 12/352,548, filed Jan. 12, 2009 on behalf of Brett A. Chromy. Dated Apr. 25, 2014. 7 pages.
Notice of Allowance for U.S. Appl. No. 12/352,548, filed Jan. 12, 2009 on behalf of Brett A. Chromy. Dated Aug. 5, 2014. 7 pages.
Non-Final Office Action for U.S. Appl. No. 14/536,513, filed Nov. 7, 2014 on behalf of Brett A. Chromy. Dated Mar. 24, 2016. 6 pages.
Notice of Allowance for U.S. Appl. No. 14/536,513, filed Nov. 7, 2014 on behalf of Brett A. Chromy. Dated Jul. 14, 2016. 5 pages.
Restriction Requirement for U.S. Appl. No. 12/469,533, filed May 20, 2009 on behalf of Paul D. Hoeprich. Dated Jun. 7, 2011. 8 pages.
Non-Final Office Action for U.S. Appl. No. 12/469,533, filed May 20, 2009 on behalf of Paul D. Hoeprich. Dated Oct. 24, 2011. 9 pages.
Non-Final Office Action for U.S. Appl No. 12/469,533, filed May 20, 2009 on behalf of Paul D. Hoeprich. Dated May 23, 2012. 12 pages.
Final Office Action for U.S. Appl. No. 12/469,533, filed May 20, 2009 on behalf of Paul D. Hoeprich. Dated Dec. 4, 2012. 6 pages.
Notice of Allowance for U.S. Appl. No. 12/469,533, filed May 20, 2009 on behalf of Paul D. Hoeprich. Dated Jul. 3, 2014. 8 pages.
Restriction Requirement for U.S. Appl. No. 12/352,472, filed Jan. 12, 2009 on behalf of Sarah E. Baker. Dated May 27, 2011. 8 pages.
Non-Final Office Action for U.S. Appl. No. 12/352,472, filed Jan. 12, 2009 on behalf of Sarah E. Baker. Dated Sep. 22, 2011. 10 pages.
Final Office Action for U.S. Appl. No. 12/352,472, filed Jan. 12, 2009 on behalf of Sarah E. Baker. Dated Jun. 7, 2012. 15 pages.
Non-Final Office Action for U.S. Appl. No. 12/352,472, filed Jan. 12, 2009 on behalf of Sarah E. Baker. Dated Oct. 2, 2013. 18 pages.
Non-Final Office Action for U.S. Appl. No. 12/352,472, filed Jan. 12, 2009 on behalf of Sarah E. Baker. Dated Dec. 26, 2014. 19 pages.
Final Office Action for U.S. Appl. No. 12/352,472, filed Jan. 12, 2009 on behalf of Sarah E. Baker. Dated Jun. 29, 2015. 18 pages.
Non-Final Office Action for U.S. Appl. No. 12/352,472, filed Jan. 12, 2009 on behalf of Sarah E. Baker. Dated Aug. 12, 2016. 20 pages.
Notice of Allowance for U.S. Appl. No. 12/352,472, filed Jan. 12, 2009 on behalf of Sarah E. Baker. Dated Mar. 17, 2017. 11 pages.
Non-Final Office Action for U.S. Appl. No. 12/118,396, filed May 9, 2008 on behalf of Mathew A. Coleman. Dated Sep. 6, 2017. 29 pages.
Restriction Requirement for U.S. Appl. No. 12/604,362, filed Oct. 22, 2009 on behalf of Paul D. Hoeprich. Dated Jan. 11, 2012. 8 pages.
Non-Final Office Action for U.S. Appl. No. 12/604,362, filed Oct. 22, 2009 on behalf of Paul D. Hoeprich. Dated May 7, 2012. 8 pages.
Final Office Action for U.S. Appl. No. 12/604,362, filed Oct. 22, 2009 on behalf of Paul D. Hoeprich. Dated Dec. 4, 2012. 6 pages.
Notice of Allowance for U.S. Appl. No. 12/604,362, filed Oct. 22, 2009 on behalf of Paul D. Hoeprich. Dated Jul. 30, 2014. 8 pages.
Crankshaw, C., "Nanodisc Technology: A Revolutionary System for Study of Membrane Proteins", Biofiles, vol. 8, No. 20, pp. 1-3; http://www.sigmaaldrich.com/technical-documents/articles/biofiles/nanodisc-technology.html; Retrieved on Aug. 4, 2015.
Cravatt et al., "Large-Scale Profiling of Protein Palmitoylation in Mammalian Cells", Nat. Methods, vol. 6, No. 2, pp. 135-138, (2009).
Eberly, J.E. et al., "Thermotolerant Hydrogenases: Biological Diversity, Properties and Biotechnical Applications", Critical Reviews in Microbiology, 34, pp. 117-130, (2008).
Sligar S., "The Self-Assembly of Integral Membrane Proteins into Nanodiscs", Sligar Lab, University of Illinois at Urbana-Champaign. Printout website dated Jun. 13, 2010, http://sligarlab.life.uiuc.edu/nanodisc/overview.html.
Stryer et al., "Oxygen Binds to Heme Prosthetic Group", Biochemistry, 4th edition, p. 148, (1995).

* cited by examiner

ELECTROCHEMICAL FLOW-CELL FOR HYDROGEN PRODUCTION AND NICOTINAMIDE DEPENDENT TARGET REDUCTION, AND RELATED METHODS AND SYSTEMS

CROSS REFERENCE TO RELATED APPLICATIONS

The present application claims priority from U.S. Provisional Patent Application No. 62/053,659 filed on Sep. 22, 2014 and may be related to U.S. patent application Ser. No. 12/352,472, filed on Jan. 12, 2009, the disclosures of which are incorporated herein by reference in their entirety.

STATEMENT OF GOVERNMENT GRANT

The United States Government has rights in this invention pursuant to Contract No. DE-AC52-07NA27344 between the United States Department of Energy and Lawrence Livermore National Security, LLC for the operation of Lawrence Livermore National Laboratory.

FIELD

The present disclosure relates to a device for hydrogen production and nicotinamide co-factor dependent target reduction processes, and related methods and systems. More particularly, it relates to an electrochemical flow-cell design and system for biological hydrogen production.

BACKGROUND

Hydrogen production is an object of several industrial and/or chemical methods. Currently, most hydrogen is produced using natural gas via steam-methane reforming (SMR). The latter requires high temperatures and pressures, and is dependent on methane (natural gas or other fossil fuel derived starting materials coming from the petroleum industry). SMR produces large amounts of carbon monoxide (CO) and, ultimately, carbon dioxide ($CO_2$).

Interest exists in using cellular hydrogenases which exhibit turnover rates several orders of magnitude higher than the most advanced inorganic catalysts to efficiently manufacture hydrogen.

However, production efforts using just hydrogenase have been challenging in view of—overall hydrogen yields, stability of the isolated enzyme in the presence of oxygen and/or availability/expense of providing co-factors.

Similar considerations apply to additional processes wherein a product is produced by a nicotinamide assisted reduction catalyzed by a membrane protein enzyme which can be challenging in view of their stability and of the yield of the related product.

SUMMARY

Provided herein are devices, methods and systems that facilitate in several embodiments, an electrochemically driven reduction of nicotinamide co-factors, to enable hydrogen or molecular production by enzymatic processes.

According to a first aspect a system and method are described for hydrogen production. The system comprises a nanolipoprotein particle presenting a nicotinamide co-factor dependent membrane hydrogenase, at least two opposing electrodes, an electrically conductive supporting structure between said first electrode and second electrode, and optionally, an ion exchange membrane between the electrically conductive supporting structure and the second electrode, wherein the nanolipoprotein particles are immobilized to the electrically conductive supporting structure. The method comprises combining protons, a nicotinamide co-factor and a nicotinamide co-factor dependent membrane hydrogenase presented on a nanolipoprotein particle immobilized on an electrically conductive supporting structure for a time and under condition to allow hydrogen production in presence of an electrical current and of an electrically driven redox mediator, such as a Pt group metal catalyst (e.g. rhodium).

According to a second aspect a system and a method of producing a reduced target molecule are described The system comprises a nanolipoprotein particle presenting a nicotinamide co-factor dependent membrane enzyme capable of catalyzing reduction of the target molecule, at least two opposing electrodes, an electrically conductive supporting structure between said first electrode and second electrode, and optionally an ion exchange membrane associated with the second electrode and between the electrically conductive supporting structure and the second electrode, wherein the nanolipoprotein particle is immobilized to the electrically conductive supporting structure. The method comprises contacting the target molecule nicotinamide co-factors and one or more electrically driven redox mediators with the nicotinamide co-factor dependent membrane enzyme presented on the nanolipoprotein particle immobilized on the electrically conductive supporting structure and applying an electric current between the electrodes, to provide reduced target molecule from the target molecules.

According to a third aspect a system and a method for hydrogen production are described. The system comprises a nicotinamide co-factor dependent membrane hydrogenase presented on a nanolipoprotein particle; and an electrochemical flow cell comprising a first electrode and a second electrode, an electrically conductive supporting structure and optionally an ion exchange membrane between said first and second electrodes. In the system, the electrochemical flow cell is configured to receive a solution in a space between the first electrode and the second electrode, the electrically conductive supporting structure is configured to immobilize the nicotinamide co-factor dependent membrane hydrogenase presented on the nanolipoprotein particle and to be exposed to the solution in the electrochemical flow cell. In some embodiments the electrochemical flow cell comprises the nanolipoprotein particles herein described immobilized on the electrically conductive supporting structure. The method comprises providing a solution containing protons, nicotinamide co-factors and one or more electrically driven redox mediators into the electrochemical flow cell and applying an electric current through the electrochemical flow cell via the electrodes, to provide hydrogen production from the protons.

According to a fourth aspect a system and a method for production of a reduced target molecule are described. The system comprises a nicotinamide co-factor dependent membrane enzyme capable of reducing the target molecule, the nicotinamide co-factor dependent membrane enzyme presented on a nanolipoprotein particle. The system further comprises an electrochemical flow cell comprising a first electrode and a second electrode, an electrically conductive supporting structure and optionally an ion exchange membrane between said first and second electrodes. In the system, the electrochemical flow cell is configured to receive a solution in a space between the first electrode and the second electrode, the electrically conductive supporting structure is configured to immobilize the nicotinamide co-factor dependent hydrogenase presented on the nanolipoprotein particle and to be exposed to the solution in the electrochemical flow cell. In some embodiments the electrochemical flow cell comprises the nanolipoprotein particles immobilized on the electrically conductive supporting structure and presenting the nicotinamide co-factor dependent membrane enzyme. The method comprises providing a solution containing the target molecule, nicotinamide co-factors and one or more electrically driven redox mediators into the electrochemical flow cell and applying an electric current through the electrochemical flow cell via the electrodes, to provide production of a reduced target molecule from the target molecule.

According to a fifth aspect a method and a systems are described, for hydrogen production. The method comprises contacting protons, a nicotinamide co-factor and a nicotinamide co-factor dependent membrane hydrogenase presented on a nanolipoprotein particle for a time and under condition to allow hydrogen production in presence of an electrical current and of an electrically driven redox mediator. The system comprises a nicotinamide co-factor, a nicotinamide co-factor dependent membrane hydrogenase presented on a nanolipoprotein particle and an electrically driven redox mediator for simultaneous combined or sequential use together with an arrangement providing the electric current according to methods herein described.

According to a sixth aspect a method and a systems are described for production of a reduced target molecule. The method comprises contacting the target molecule, a nicotinamide co-factor and a nicotinamide co-factor dependent membrane enzyme capable of reducing the target molecule, nicotinamide co-factor dependent membrane enzyme presented on a nanolipoprotein particle for a time and under condition to allow production of the reduced target molecule in presence of an electrical current and of an electrically driven redox mediator. The system comprises a nicotinamide co-factor, a nicotinamide co-factor dependent membrane enzyme capable of reducing the target molecule presented on a nanolipoprotein particle and an electrically driven redox mediator for simultaneous combined or sequential use together with an arrangement providing the electric current according to methods herein described.

According to a seventh aspect a method of providing a system for hydrogen production is described, the method comprising providing an electrochemical flow cell herein described and connecting a nanolipoprotein particle presenting a nicotinamide co-factor dependent membrane hydrogenase to the electrically conductive supporting structure of the electrochemical flow cell.

According to an eighth aspect a method of providing a system for production of reduced target molecule is described, the method comprising providing an electrochemical flow cell herein described and connecting a nanolipoprotein particle presenting a nicotinamide co-factor dependent membrane enzyme capable of reducing the target molecule to the electrically conductive supporting structure of the electrochemical flow cell.

The devices, methods and systems herein described, allow in several embodiments, a basic platform that will offer consistency in reaction conditions assuring reproducibility and overall maximum yields from a given biological red/ox process/transformation/reaction.

The devices, methods and systems herein described can be applied in several fields such as basic biology research, applied biology, bio-engineering, bio-energy, and bio-fuels and additional fields identifiable by a skilled person.

The details of one or more embodiments of the disclosure are set forth in the accompanying drawings and the description below. Other features, objects, and advantages will be apparent from the description and drawings, and from the claims.

BRIEF DESCRIPTION OF DRAWINGS

The accompanying drawings, which are incorporated into and constitute a part of this specification, illustrate one or more embodiments of the present disclosure and, together with the description of example embodiments, serve to explain the principles and implementations of the disclosure.

FIG. 7 shows a chart illustrating results of a size exclusion chromatography of an assembly mixture containing MBH-NLP (Hydrogenase+NLP), hydrogenase (Hydrogenase–no NLP) and empty NLP (Empty NLP).

DETAILED DESCRIPTION

Figure 1:
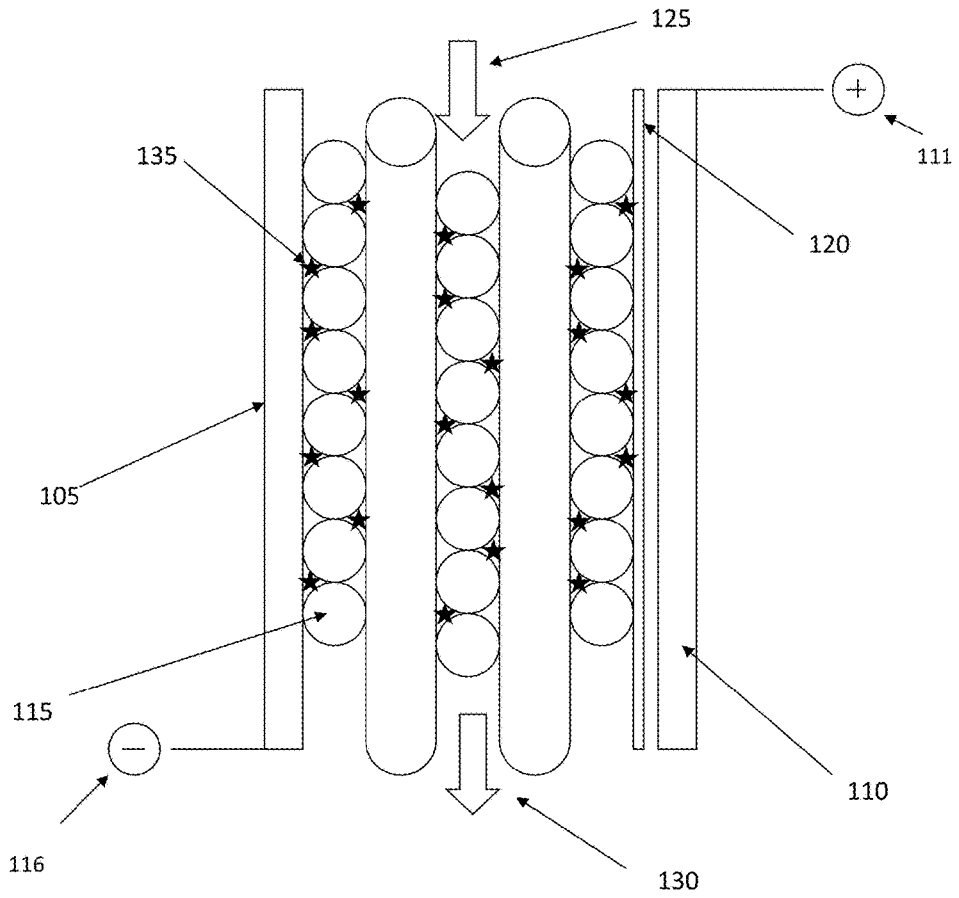
FIG. 1 illustrates one embodiment of an electrochemical cell.

Provided herein are devices, methods, and systems that in several embodiments allow electrochemically driven recycling of nicotinamide co-factors for hydrogen production by NLP-hydrogenase or production of reduced molecules.

The term "electrochemically driven" as used herein in connection with a reaction indicates a reaction that is caused or maintained by an externally supplied electric current. In particular, electrochemically driven reactions in the sense of the present disclosure, are chemical reactions where electrons are directly transferred between molecules and/or atoms (such as oxidation-reduction or redox reactions) wherein the transfer of electrons from and/or to at least one of the molecule and/or atoms involved in the reaction is caused by the electric current. In general, in methods and systems herein described the electric current is a flow of electric charges carried by ions in an electrolyte, or by both ions and electrons depending on the specific components of the system where the flow of electric charges is carried, as well as on the related charge carriers in the system as will be understood by a skilled person.

An "electric current" in the sense of the description can be described both as a flow of positive charges or as, as an equal flow of negative charges in the opposite direction. In embodiments herein described the charge carriers are provided by electrons or negatively charged ions flowing into the system even if the direction of the current is indicated in schematic representations of the disclosure as the direction of the flow of positive charges in accordance with the definition of conventional current in electrical systems.

In particular, in embodiments herein described devices, methods, and systems allow hydrogen production via reduction of other target through an electrochemical co-factor reduction step that provides electrons to the NLP-hydrogenase and facilitates reduction of protons (H+) to molecular hydrogen ($H_2$). Accordingly in those embodiments, the electric current is not used to generate hydrogen directly via electrolysis of water, but rather is directed towards facilitating the NAD co-factor red/ox reaction as described herein.

In several embodiments, herein described, the electrochemically driven reduction is the reduction of nicotinamide co-factors which enables hydrogen production, or any other reduction catalyzed by a nicotinamide co-factor dependent membrane enzyme able to react in presence of a nicotinamide co-factor.

Hydrogen production as used herein indicates hydrogen produced by a hydrogenase, an enzyme that catalyzes the reduction of 2H+ to molecular hydrogen ($H_2$), according to the reaction $$2H^+ + D_{red} \rightarrow H_2 + D_{ox}$$

wherein hydrogen production is coupled to the oxidation of electron acceptors provided by of a nicotinamide co-factor (D in the above reaction). It is known that formate dehydrogenase as $D_{red}$ produces this reaction with $CO_2$ as $D_{ox}$.

The term "nicotinamide co-factor dependent membrane enzyme" indicates a membrane protein which is capable of binding a nicotinamide co-factor to catalyze reduction of a corresponding reduction target in a reaction also resulting in oxidization of a nicotinamide co-factor. A membrane protein indicates a protein having a structure that is suitable for attachment to or association with a biological membrane or a bilayer membrane (i.e. an enclosing or separating amphipathic lipid bilayer that acts as a barrier within or around a cell). In particular, membrane enzymes include proteins that contain large regions or structural domains that are hydrophobic (the regions that are embedded in or bound to the membrane); those proteins can be extremely difficult to work with in aqueous systems, since when removed from their normal lipid bilayer environment those proteins tend to aggregate and become insoluble. Accordingly, nicotinamide co-factor dependent membrane enzymes are proteins that typically can assume an active form wherein the membrane protein exhibits one or more functions or activities, and an inactive form wherein the membrane protein does not exhibit those functions/activities, e.g. oxidoreductase and transhydrogenase enzymes. Examples of nicotinamide co-factor dependent membrane enzyme include proton-translocating enzymes or transhydrogenases (PTH); that are membrane associated enzymes and in some varieties contain 14 transmembrane helices. Examples of nicotinamide co-factor dependent membrane enzyme also include malate dehydrogenase, succinate dehydrogenase, L-lactate dehydrogenase, formate dehydrogenase, and proline dehydrogenase.

The term "reduction target molecule" indicates a substrate molecule capable of accepting least one electron from a corresponding nicotinamide co-factor dependent membrane enzyme to form a desired reduced product. As used herein, the term "corresponding" as related to an enzyme and target molecule refers to an enzyme and target molecule that can react one with the other. Thus, a nicotinamide co-factor dependent membrane enzyme that can react with a reduction target molecule can be referred to as corresponding nicotinamide co-factor dependent membrane enzyme for that target molecule. Similarly a target molecule that can react with a nicotinamide co-factor dependent membrane enzyme can be referred as a corresponding target molecule for that nicotinamide co-factor dependent membrane enzyme.

In various examples a reduction target molecule can accept electrons provided by the NAD-dependent membrane enzyme e.g. H+ in a hydrogenase catalyzed hydrogen production, net reaction is:

$$2H^+ + 2e^- \rightarrow H_2.$$

In various embodiments the rhodium-chelate donates at least one electron to the nicotinamide co-factor which in turn is used by NAD-dependent membrane hydrogenase to produce molecular hydrogen. The reaction catalyzed by the enzyme is:

$$2NADH + 2H^+ \rightarrow 2NAD^+ + H_2.$$

The term "nicotinamide cofactor" as used herein indicates a co-factor comprising two nucleotides joined through their phosphate groups or a synthetic analogue thereof. Exemplary nicotinamide family of co-factors are nicotinamide adenine dinucleotide (or NAD) and nicotinamide adenine dinucleotide phosphate (or NADP).

In a nicotinamide adenine dinucleotide (NAD), the nucleotides consist of ribose rings, one with adenine attached to the first carbon atom (the 1' position) and the other with nicotinamide at this position as shown in formula (I).

(I)

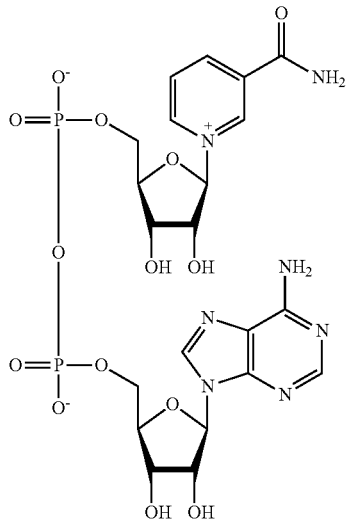

The nicotinamide moiety can be attached in two orientations to this anomeric carbon atom. Because of these two possible structures, the compound exists as two diastereomers as will be understood by a skilled person. The β-nicotinamide diastereomer of NAD is the diastereomer found in biological organisms. These nucleotides are joined together by a phosphodiester bond between 5' hydroxyls. Metabolically, the compound accepts or donates electrons in redox reactions. Such reactions (summarized as $RH_2+NAD^+ \rightarrow NADH+H^++R$) involve the removal of two hydrogen atoms from the reactant (R), in the form of a hydride ion ($H^-$), and a proton ($H^+$). The proton is released into solution, while the reductant $RH_2$ is oxidized and NAD reduced to NADH by transfer of the hydride to the nicotinamide ring.

In particular, in redox reactions catalyzed by a NAD from the hydride electron pair, one electron is transferred to the positively charged nitrogen of the nicotinamide ring of $NAD^+$, and the second hydrogen atom transferred to the C4 carbon atom opposite this nitrogen, as schematically shown below

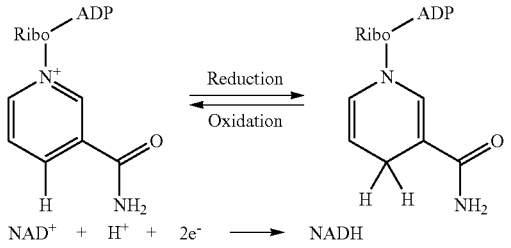

The midpoint potential of the $NAD^+$/NADH redox pair is typically −0.32 volts, which makes NADH a strong reducing agent.

Nicotinamide adenine dinucleotide phosphate differs from nicotinamide adenine dinucleotide in the presence of an additional phosphate group on the 2' position of the ribose ring that carries the adenine moiety. In particular, nicotinamide adenine dinucleotide phosphate can be represented by the chemical formula:

(II)

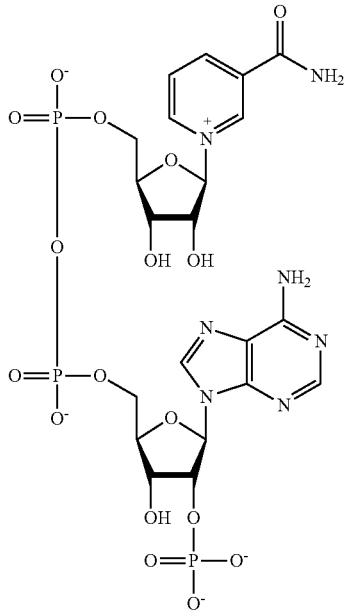

The structural and catalytic functionalities of the nicotinamide adenine dinucleotide phosphate are otherwise the same of the nicotinamide adenine dinucleotide.

An analogue of a nicotinamide co-factor and in particular of a nicotinamide adenine dinucleotide (NAD) or a nicotinamide adenine dinucleotide phosphate (NADP) is a chemical compound that is structurally similar to the reference nicotinamide co-factor but differs slightly in composition (as in the replacement of one atom by an atom of a different element or in the presence of a particular functional group) while maintain the ability to maintain the redox ability of the reference co-factor. For example analogues of the nicotinamide co-factor are compounds that maintain the positively charged nitrogen of the nicotinamide ring of $NAD^+$, and the second hydrogen atom transferred to the C4 carbon atom opposite this nitrogen while changing one or more of the remaining atoms and moieties of the compound.

In devices, methods and systems herein described, reduction processes catalyzed by a nicotinamide co-factor dependent membrane enzyme in presence of a nicotinamide co-factor and resulting in an oxidized nicotinamide co-factor can be performed as electrochemically driven reaction wherein reduction of the oxidized nicotinamide co-factor is performed by an applied electrical current. In particular, in embodiments herein described the applied electric current provides electrons for the reduction of the oxidized nicotinamide co-factor which is then converted in a reduced oxidized co-factor, thus restoring the nicotinamide co-factor necessary for the enzymatic reduction performed in accordance with the disclosure.

Accordingly, in devices methods and systems herein described reduction of a target molecule can be performed by combining: a nicotinamide co-enzyme, a corresponding reduction target, and a nicotinamide co-factor dependent membrane enzyme within a nanolipoprotein particle in presence of an electric current and a redox mediator; combined for a length time and under the proper conditions to allow reduction of the reduction target by the a nicotinamide co-factor dependent membrane enzyme, thereby obtaining a corresponding reduced product.

Several enzyme-mediated biological reduction reactions catalyzed by a nicotinamide co-factor are expected to be performed in similar devices, using methods, and systems described herein and to result in one or more reduced products. Examples include: hydrogen production by membrane hydrogenases, reduction of oxaloacetate to malate catalyzed by a malate dehydrogenase, reduction of fumarate to succinate catalyzed by succinate dehydrogenase, reduction of lactate to pyruvate catalyzed by lactate dehydrogenase, reduction of carbon dioxide to formate catalyzed by formate dehydrogenase and reduction of (S)-1-pyrroline-5-carboxylate to L-proline. Additional reductions catalyzed by a nicotinamide driven membrane enzyme are identifiable by a skilled person.

In particular, in exemplary devices methods and systems described herein, the nicotinamide co-factor dependent membrane enzyme is comprised of a membrane protein within a nanolipoprotein particle.

The term "membrane protein" as used herein indicates any protein having a structure that is suitable for attachment to or association with a biological membrane or biomembrane (an enclosing or separating amphipathic layer that acts as a barrier within or around a cell). In particular, exemplary membrane proteins comprise membrane proteins, and in particular proteins that can be associated with the membrane of a cell or an organelle, such as integral membrane proteins (a protein including at least one transmembrane domain which indicates any protein segment which is thermodynamically stable in a membrane, as will be understood by a skilled person and comprise a protein (or assembly of proteins) that are stably attached to the biological membrane), or peripheral membrane proteins (proteins including at least one transmembrane domain that are reversibly attached to the biological membrane to which they are associated). Typically integral membrane proteins can be separated from the biological membranes using detergents, nonpolar solvents, or some denaturing agents as will be understood by a skilled person. In some instances, peripheral membrane proteins attach to integral membrane proteins, or penetrate the peripheral regions of the lipid bilayer with a reversible attachment.

The term "nanolipoprotein particle", "nanodisc," "rHDL", or "NLP" as used herein indicates a supramolecular complex formed by a membrane forming lipid and a scaffold protein, that following assembly in presence of a membrane protein also include the membrane protein. The scaffold protein and membrane protein constitute protein components of the NLP. The membrane forming lipid constitutes a lipid component of the NLP. In particular the membrane forming lipid component is part of a total lipid component, (herein also membrane lipid component or lipid component) of the NLP together with additional lipids such as functionalized lipids and polymerizable lipids, that can further be included in the NLPs as will be understood by a skilled person upon reading of the present disclosure. The scaffold protein component is part of a protein component of the NLP together with additional proteins such as membrane proteins, target proteins and other proteins that can be further included as components of the NLPs as will be understood by a skilled person upon reading of the present disclosure. Additional components can be provided as part of the NLP herein described as will be understood by a skilled person. In particular the membrane lipid bilayer can attach membrane proteins or other amphipathic compounds through interaction of respective hydrophobic regions with the membrane lipid bilayer. The membrane lipid bilayer can also attach proteins or other molecule through anchor compounds or functionalized lipids as will be understood by a skilled person upon reading of the disclosure. Predominately discoidal in shape, nanolipoprotein particles typically have diameters between 10 to 20 nm, share uniform heights between 4.5 to 5 nm and can be produced in yields ranging between 30 to 90%. The particular membrane forming lipid, scaffold protein, the lipid to protein ratio, and the assembly parameters determine the size and homogeneity of nanolipoprotein particles as will be understood by a skilled person. In the nanolipoprotein particle the membrane forming lipid are typically arranged in a membrane lipid bilayer confined by the scaffold protein in a discoidal configuration as will be understood by a skilled person.

The term "membrane forming lipid" or "amphipathic lipid" as used herein indicates a lipid possessing both hydrophilic and hydrophobic properties that, in an aqueous environment, assemble in a lipid bilayer structure that consists of two opposing layers of amphipathic molecules know as polar lipids. Each polar lipid has a hydrophilic moiety, i.e., a polar group such as, a derivatized phosphate or a saccharide group, and a hydrophobic moiety, i.e., a long hydrocarbon chain. Exemplary polar lipids include phospholipids, sphingolipids, glycolipids, ether lipids, sterols and alkylphosphocholines. Amphipathic lipids include but are not limited to membrane lipids, i.e. amphipathic lipids that are constituents of a biological membrane, such as phospholipids like dimyristoylphosphatidylcholine (DMPC) or dioleoylphosphoethanolamine (DOPE) or dioleoylphosphatidylcholine (DOPC), or dipalmitoylphosphatidylcholine (DPPC). Additional exemplary polar lipids include synthetic phospholipid-based asymmetric bolaamphiphile mimetic of the natural lipids in archaea (see Kovacs, K. L.; Maroti, G.; Rakhely, G. International Journal of Hydrogen Energy 2006, 31, (1 I), 1460-1468), which are particularly suitable in embodiments wherein performance of reactions at a high temperature is desired since the structure of the archaea lipids is thought to keep the membrane intact at upwards of 90° C.

The term "scaffold protein" as used herein indicates any protein that comprises amphipathic alpha-helical segments and that is capable of self-assembly with an amphipathic lipid in an aqueous environment, organizing the amphipathic lipid into a bilayer, and include but are not limited to apolipoproteins, lipophorins, derivatives thereof (such as truncated and tandemly arrayed sequences) and fragments thereof (e.g. peptides), such as apolipoprotein E4, 22K fragment, lipophorin III, apolipoprotein A-1, apolipophorin III from the silk moth *B. mori*, and the like. In particular, in some embodiments rationally designed amphipathic peptides can serve as a protein component of the NLP.

In some embodiment, the peptides forming a scaffold protein are amphipathic helical peptides that mimic the alpha helices of an apolipoprotein component that are oriented with the long axis perpendicular to the fatty acyl chains of the amphipathic lipid and in particular of the phospholipid.

The term "protein" as used herein indicates a polypeptide with a particular secondary and tertiary structure that can participate in, but not limited to, interactions with other biomolecules including other proteins, DNA, RNA, lipids, metabolites, hormones, chemokines, and small molecules. The term "polypeptide" as used herein indicates an organic polymer composed of two or more amino acid monomers and/or analogs thereof. Accordingly, the term "polypeptide" includes amino acid polymers of any length including full length proteins and peptides, as well as analogs and fragments thereof. A polypeptide of three or more amino acids can be a protein oligomer or oligopeptide.

As used herein the term "amino acid", "amino acidic monomer", or "amino acid residue" refers to any of the twenty naturally occurring $\alpha$-amino acids including synthetic amino acids with unnatural side chains and including both D and L optical isomers. The term "amino acid analog" refers to an amino acid in which one or more individual atoms have been replaced, either with a different atom, isotope, or with a different functional group but is otherwise identical to its natural amino acid analog.

The membrane forming lipid and protein components of the NLP are generally able to self-assemble in a biologically (largely aqueous) environment according to the thermodynamics associated with water exclusion (increasing entropy) during hydrophobic association. As such, it is expected that membrane associated proteins describe herein will be accommodated in the NLP structure.

In some embodiments of the methods and systems herein provided, nanolipoprotein particles (NLP) comprising the nicotinamide co-factor dependent membrane enzyme are formed by allowing the amphipathic lipid and the protein components of the NLP including the nicotinamide-dependent membrane enzyme to assembly in a cell free expression system.

In particular, in some embodiments the NLP components can be contacted to form an admixture that is then preferably subjected to a temperature transition cycle in presence of a detergent. In the temperature cycle, the temperature of the admixture is raised above and below the gel crystalline transition temperature of the membrane forming lipids. Exemplary procedures are illustrated in Example 1 of the present application and comprise in situ incorporation of the hydrogenase into self-assembling NLPs (described in examples section where lipid, scaffold, MBH, possibly surfactant are added together and subjected to transition temp fluctuation to assemble NLPs and incorporate MBH simultaneously). A further description of this method can also be found in the U.S. patent application entitled "Nanolipoprotein Particles and Related Methods and Systems for Protein Capture Solubilization and/or Purification" Ser. No. 12/352,548 filed on Jan. 12, 2009 and incorporated herein by reference in its entirety.

Exemplary additional methods to provide nanolipoprotein particles which are expected to be applicable to provide one or more NLPs presenting one or more nicotinamide co-factor dependent membrane enzyme of the present disclosure, comprise the methods described in U.S. Patent Publication No. 2009/0192299 related to methods and systems for assembling, solubilizing and/or purifying a membrane associated protein in a nanolipoprotein particle, which comprise a temperature transition cycle performed in presence of a detergent, wherein during the temperature transition cycle the nanolipoprotein components are brought to a temperature above and below the gel to liquid crystallization transition temperature of the membrane forming lipid of the nanolipoprotein particle. In some embodiments, verification of inclusion of a nicotinamide driven membrane enzyme in an active form can be performed using the methods and systems for monitoring production of a membrane protein in a nanolipoprotein particle described in U.S. Patent Publication No. 2009/0136937 filed on May 9, 2008 with Ser. No. 12/118,530 which is incorporated by reference in its entirety.

In various embodiments of the present invention the nanolipoprotein particle is immobilized to a supporting structure operated in combination with additional elements generating the applied electrical current. The term "immobilize" as used herein indicates the act fixing to an electrode or an electrically conductive supporting structure, an NLP comprising a nicotinamide driven membrane enzyme. The term "fixing" or "fix" as used herein, refers to connecting or uniting by a bond, link, force or tie in order to keep two or more components together in a stable complex formed by the two reference items. In particular, exemplary fixing can be performed by linking the two items covalently or by non-specific forces (e.g. Van der Waals forces). Fixing as used herein encompasses either direct or indirect attachment where, for example, a first molecule is directly bound to a second molecule or material, or one or more intermediate molecules are disposed between the first molecule and the second molecule or material as long as the resulting complex is stable under the operating conditions. The term encompasses also attachment by physical forces which are applied to the reference items to provide a complex that stable mechanically and thermally under the operating conditions.

In various embodiments, the NLP comprising the nicotinamide driven enzyme can be immobilized on the supporting structure via biotin labeled proteins also comprised as membrane proteins within the NLPs with the small protein avidin directly fixed to the surface. In various embodiments, the nicotinamide co-enzyme can be tagged with poly histidine residues or another anchor compound substrate in an NLP using functionalized membrane lipid using the methods described in U.S. patent application Ser. No. 12/469,533 incorporated herein by reference in its entirety. The polyhistidine (or other anchor compound substrate) presented on the NLP will then bind to an attachment site of nitrilotriacetic acid nickel (NTA-Ni) (or other anchor compound) presented on the functionalized surface. In other embodiments additional methods other than avidin-biotin, (e.g. NLP-biotin and avidin-target), can be used. For example an NLP-$N_3$ and an alkyne-containing molecule which interact through "click-chemistry" can be used as will be understood by a skilled person.

The term "present" as used herein with reference to a compound or functional group indicates attachment performed to maintain the chemical reactivity of the compound or functional group as attached. Accordingly, a functional group presented on a NLP, is able to perform under the appropriate conditions the one or more chemical reactions that chemically characterize the functional group. Similarly, a nicotinamide driven membrane enzyme presented on an NLP is able to perform, under appropriate conditions, the same biological and chemical reactions that characterize the nicotinamide co-factor dependent membrane enzyme.

In embodiments of devices, methods and systems herein described combining the nicotinamide co-factor dependent membrane enzyme presented on an NLP with a target reduction molecule and nicotinamide co-factor is performed as an electrochemically driven reaction in presence of an electric current. The electrochemical cell-based reduction of nicotinamide co-factor described herein can be used in a nicotinamide dependent hydrogen formation as well as in a number of other nicotinamide dependent biological transformations, e.g. those enzyme systems mentioned in the present disclosure and additional enzyme identifiable by a skilled person.

In particular, in several embodiments, the applied electrical current can be generated by a pair of electrodes operated typically in connection with a current generator.

The term "electrode" as used herein indicates a material that conducts electricity and is configured to be attached to a current or voltage generator in order to permit a flow of current. The term "cathode" as used herein indicates the negatively charged electrode that takes in electrons from outside the cell, from the current or voltage generator for example, and allows them into the interior of the cell to participate in co-factor mediated enzymatic based molecular reduction. The term "anode" as used herein indicated the positively charged electrode that allows electrons from inside the cell to go back to the current or voltage generator (oxidation) to complete the electrical circuit. In particular, since the direction of the flow of electrons is opposite the direction of electric current, the current (as commonly defined) enters the anode and exits the cathode. These definitions for "anode" and "cathode" follow the convention for an electrolytic cell. A galvanic cell, such as a battery, would use the opposite convention. Examples of potential electrode materials include Ag/Cl, Hg, and Pt. The term "electrically conductive supporting structure" provides a conduit for the electrical current to flow through inside a flow cell configured to allow immobilization of a nanolipoprotein particle.

In particular, the electrically conductive supporting structure can be chemically inert, where the term chemically inert indicates a substance that is not chemically reactive to the reagents for the nicotinamide dependent reactions performed by the system. In some embodiments, the electrically conductive supporting structure is a porous supporting structure.

In some embodiments, the electrically conductive porous supporting structure comprises graphite beads having a diameter less than or equal to 400 μm. In some embodiments, the electrically conductive porous supporting structure is a mesoporous structure. In some embodiments, the mesoporous structure comprises a three-dimensional mesoporous carbon network structure. In some embodiments, the mesoporous structure can also comprise graphitic carbons. In some embodiments, the mesoporous structure is a graphitic carbon aerogel.

In various examples an electrically conductive supporting structure can indicate a porous structure, such as a mesoporous structure, that can provide support to nicotinamide driven enzymes. A mesoporous structure can be a structure that is porous with pore dimensions in the micrometer or nanometer range, e.g. graphene. In some embodiments, mesoporous structure can have a pore size large enough to contain the biological molecules, for example about 30 nm or larger for NLPs with hydrogenase, but small enough to produce a large surface area, for example 100 $m^2$/gram and higher as provided by mesocellular foams.

In other examples an electrically conductive supporting structure can be an interlinked network of struts and empty spaces which can be made of graphitic carbon or graphene. Additionally, the supporting structure can be a packed group of graphite beads. An example of an electrically conductive supporting structure includes graphite beads, e.g. small carbon spheroids or particles, including particles smaller than 1 mm in diameter. The term "graphitic carbon" as used herein indicates a form of pure carbon. In some embodiments the graphitic carbon can be graphene in a 2-dimensional lattice, e.g. a thin, nearly transparent sheet, one atom thick. An example of graphene is the Single Layer Graphene product from ACS Material.

The term "current generator" as used herein indicates a device that generates an electric current. The term "voltage generator" as used herein indicates a device that supplies an electric voltage. The two terms are used interchangeably herein to indicate a device that provides electrons into the cell via the cathode. An example of a current/voltage generator is a potentiostat (such as the BAS100B™ from Bioanalytical Systems™). Likewise a galvanostat might be used. Almost any generator can be used that can provide the required voltage for a given cell, preferably one with a controllable voltage or current setting so that multiple values can be tested to determine a setting for optimal production for a given cell. The term "power supply" can refer to either a current generator or a voltage generator.

In some embodiments, the system can also comprise a voltage generator, connected to the first and second electrode. In some embodiments, the voltage generator is configured to create an electric potential of ~500 mV between the first and second electrodes.

In particular, in some embodiments the electrodes and current generator can be operated in combination with: an ion exchange membrane separating the reaction mixture from the electrodes. The term "ion exchange membrane" as used herein indicates an optional membrane that allows the transfer of ions, but separates the electrically conductive supporting structure from the anode preventing re-oxidation of the products. Examples of ion exchange membranes include IONAC MC3470™, SnowPure Excellion™, as well as additional membranes identifiable by a skilled person.

In some embodiments, a space defined by the electrodes can be fluidically connected with one or more reservoirs and/or gas containers configured to host reagents for the reduction reaction or the related reduction product. In particular fluidic connection can be performed through conduits connecting the space between the electrodes and the one or more reservoirs and/or gas containers in accordance with configuration which depend on the physical and chemical nature of the reagents or product that are transferred from/to the space between the electrodes.

The term "reservoir" as used herein indicates any kind of container configured to contain a liquid. The term "gas container" as used herein indicates any kind of container configured to contain as gas. The term "conduit" as used herein indicates a means to provide a fluidic flow from one point to another, for example a pipe, tube, or channel.

In some embodiments, the electrodes, ion exchange membrane, reservoir, product container and related conduits can be organized in an electrochemical flow cell.

The term "electrochemical flow cell" as used herein indicates a cell, device, container or similar objects, which can comprise electrodes in order to provide an electrical current flowing within its content or parts of its content; the cell can also be configured to contain a chemical solution. Further, the cell can be configured to be able to attach to conduits in order to provide a fluidic flow of a solution through the cell. For example, the conduits can provide entry of a solution from a reservoir into the part of the cell where reactions might take place, and can also provide an exit of a solution from the part of the cell where reactions might take place, towards the solution reservoir. The cell can also comprise a gas container, for example configured to contain hydrogen when it's produced by hydrogenase inside the cell. Alternatively, the gas container can be external to the cell. The cell can comprise different components such as an electrically conductive supporting structure and an ion exchange membrane.

In some embodiments the electrodes, the electrically conductive supporting structure, and/or the ion exchange membrane can be comprised inside an electrochemical flow cell, where the electrodes are placed at least two opposing sides and the ion exchange membrane is positioned between the electrodes in a configuration that minimize the interaction of particles with at least one of the electrodes.

In particular, in some embodiments the electrodes and current generator in particular when comprised within an electrochemical flow cell can be connected to a reservoir providing reagents to the reaction mixture, typically in a solution; and a product container, such as a gas container, collecting the product of the reaction, wherein the reservoir and the product container are fluidically connected to the reaction mixture by suitable conduits. In particular the solution can be flown through the electrochemical flow cell while voltage is applied by the electrodes in the cell. Different configuration of the conduits can be provided which depend on the chemical and physical status of the reduction product (gaseous liquid or solid) as will be understood by a skilled person.

In some embodiments, the method to produce hydrogen or a reduced target molecule can also comprise capturing the reduced product, such as hydrogen gas, generated in the electrochemical flow cell.

In some embodiments, the system can comprise a first set of conduits connecting a reservoir to the electrochemical flow cell, configured to allow a movement of a solution, such as a buffer solution, from the solution reservoir to the electrochemical flow cell and from the electrochemical flow cell to the solution reservoir; and a second set of conduits connecting a gas container to the electrochemical flow cell, configured to allow a movement of hydrogen and/or oxygen from the electrochemical flow cell to the gas container.

In some embodiments, conduits connecting the reservoir to the chamber can be also connected to one or more pumps.

The term "pump" as used herein indicates a device which is configured to flow a fluid through a conduit and/or in and out of a reservoir. An example of a pump includes the Cole-Parmer Masterflex™.

In some embodiments, an electrochemical flow cell in accordance with the disclosure comprises: a nanolipoprotein particle presenting a nicotinamide co-factor dependent membrane enzyme; a first and a second electrode; an electrically conductive porous supporting structure between said first and second electrodes, and an ion exchange membrane between the electrically conductive porous supporting structure and the second electrode; wherein the electrically conductive porous supporting structure is connected to the nanolipoprotein particle so that the nanolipoprotein particle is immobilized on the electrically conductive porous supporting structure presenting the nicotinamide co-factor dependent membrane enzyme.

In particular, an exemplary electrochemical cell is depicted in FIG. 1 and can comprise a first electrode (105) and a second electrode (110), packed graphite particles (115) which form an electrically conductive supporting structure next to the cathode (105), and an ion exchange membrane (120) isolating the anode (110). A buffer solution can enter the cell (125), and then exit the cell (130). A small electric voltage (e.g. 100 to 600 mV in the case of a cell with a 10 cm×1 cm×1 cm supporting structure, a supporting structure with 200-400 μm particle diameter, and a buffer flow rate of 2 $cm^3$ per minute, typically resulting in a current of up to 6.5 mA) can be applied across the electrodes (105, 110) such that the cathode (105) has a negative charge, thereby providing electrons into the cell. The term "buffer solution" as used herein indicates a solution containing components necessary for the activation or catalysis of enzyme activity inside a flow cell. For example, in some embodiments the buffer solution can contain nicotinamide co-enzymes and electrically driven reduced redox mediators. In some embodiments the buffer solution can comprise phosphate buffered saline ("PBS"), at a pH of 7.4. Alternative buffers such as HEPES (4-(2-hydroxyethyl)-1-piperazine-ethanesulfonic acid) can also be used in certain embodiments.

In some embodiments, the solution contains nicotinamide co-enzyme and redox mediator capable of being recycled in presence of an electric current.

Figure 2:
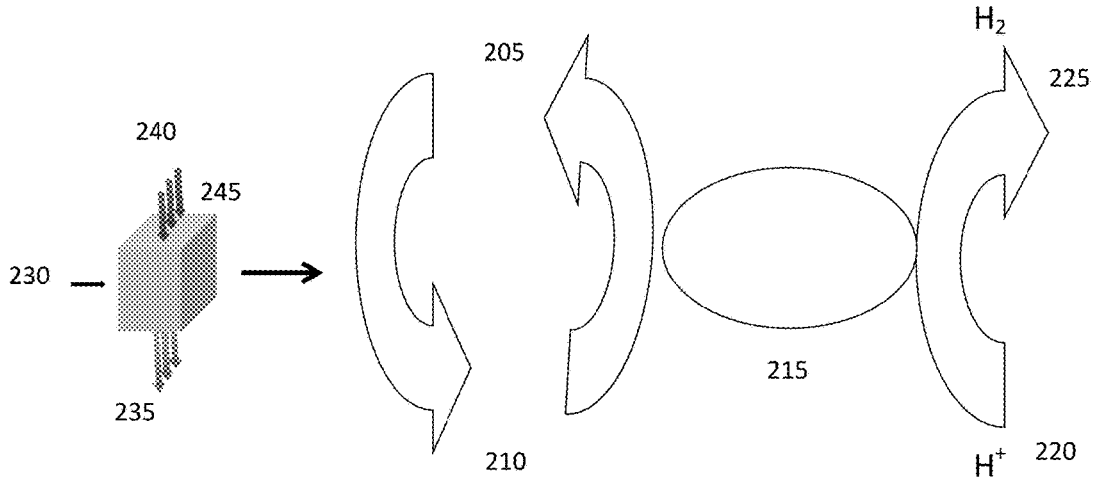
FIG. 2 illustrates an overview of an example of reaction which facilitates reduction of a reduction target.

FIG. 2 illustrates an exemplary embodiments schematically showing how $NADP^+$ (205) is regenerated into NADPH (210) in order to aid the exemplary nicotinamide driven membrane enzyme provided by the NLP hydrogenase (215) converting $H^+$ (220) into $H_2$ (225). The process starts with an input current (230) being provided into the electrochemical cell (245) while the redox mediator and nicotinamide co-enzyme flows into the cell (240) and the reduced nicotinamide co-enzyme in conjunction with reduced redox mediator (235) is available for consumption by the NLP-hydrogenase complex, all within the flow cell.

Figure 3:
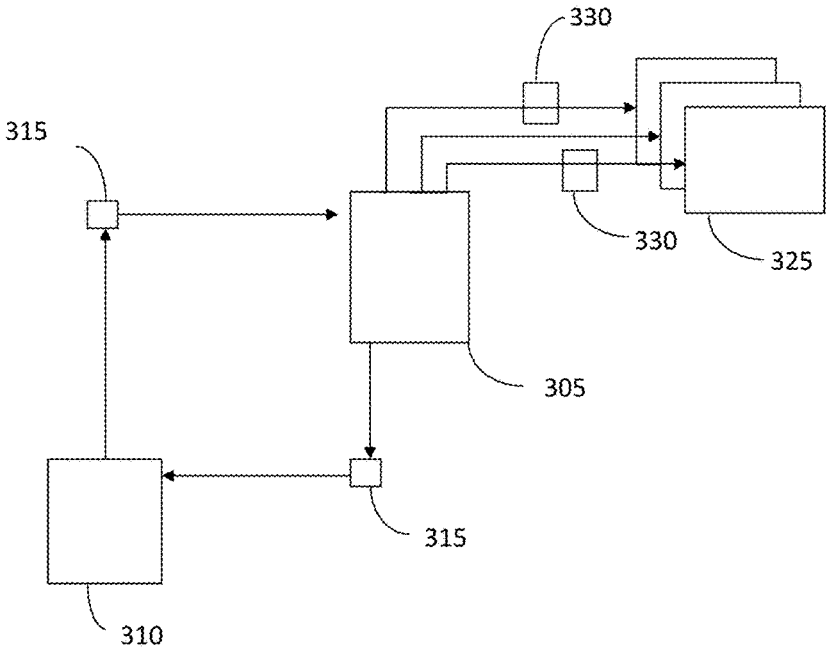
FIG. 3 illustrates an exemplary system incorporating an electrochemical flow-cell.

FIG. 3 illustrates an exemplary system incorporating an electrochemical flow-cell further comprising a reservoir and a gas container. For example, a flow-cell (305) can be connected to a buffer solution reservoir (310) through pumps (315). The flow-cell can be further connected directly to one or more gas collection reservoirs (325). A gas flow meter can also be present (330)-with any of the gas collection reservoirs (325).

In some embodiments, the electrochemical reduction of enzyme co-factor (e.g. $NADP^+$) can be mediated by interaction with an electrically driven redox mediator in a reduced form at neutral pH in a fluidized bed of inert graphite particles. As the solution is flowed through an electrochemical cell such as that of FIG. 1, NADPH becomes available for driving the enzymatic reduction of protons to molecular hydrogen.

The term "electrically driven redox mediator" (herein also referred to as EDRM) includes various soluble inorganic and chelated inorganic metallic compounds configured to be reduced at an electrode interface in an electrochemical cell and selectively oxidized via reduction of a nicotinamide co-enzyme. An electrically driven reduced redox mediator is capable of transfer of electrons to a nicotinamide co-factor molecule and has an electrochemical activation energy at potentials less negative than −0.9V vs. SCE, since at more negative potentials that direct electrochemical reduction of the nicotinamide co-factor (e.g. $NAD(P)^+$) could lead to formation of a nicotinamide co-factor dimer (e.g. $NAD(P)^+$ dimer).

In some embodiments, the redox mediator comprises a metallic redox mediator.

Figure 4:
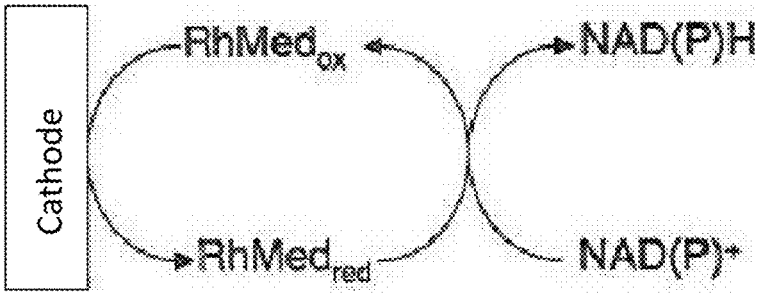
FIG. 4 is an exemplary schematic representation of the regeneration of an electrically driven/recycled redox mediator, e.g. RhMed, and subsequently a nicotinamide co-enzyme, e.g. NAD(P).

A schematic representation of the conversion of exemplary nicotinamide co-factor $NADP^+$ into the reduced form NADPH by the exemplary electrically driven redox mediator RhMed is shown in FIG. 4.

Examples for an electrically driven reduced redox mediator include metal electrically driven redox mediators with complexes containing a metal as a central atom. Examples of metals of which the central atom can be comprised include, for an example $Rh^I$, $Rh^{III}$, $Ru^I$, $Ru^{III}$, $Ir^I$, $Ir^{III}$, $Fe^{II}$, $Fe^0$, $Ni^{II}$, $Ni^I$, $Ni^0$, $Co^{III}$, or $Co^I$, and examples of ligand that can be used in conjunction with said metallic central atoms include, for example 2,2'-bipyridine, 4,4'-dimethyl-2,2'-bipyridine, 1, 10-phenanthroline, 2,2',6',2"-terpyridine, a tetra-azamacrocyclic structure, a porphyrin, a phthalocyannine or NO.

Examples for a metal electrically driven redox mediator metal complexes such as $[Rh(bipy)_3]^{3+}X_3^-$, $[Rh(bipy)_2]^{3+}X_3^-$, $[Rh(bipy)_2(H_2O_2)]^{3+}X_3^-$, $[Ni(PPh_3)_2]^{2+}X_2$, $[Rh(bipy)_2(H_2O)]^+X^-$, $[Ru(bipy)_3]^{3+}X_3^-$, $[Rh(bipy)_2(OH)_2]^+X^-$, $[Fe(NO)_2Cl]_2$, $[Rh(bipy)(H_2O)]^+X^-$, $[Co(NO)_2Br]_2$, in which X is an anion, e.g. Cl.

A particular example of a metal electrically driven redox mediator includes (pentamethylcyclopentadienyl-2,2'-bipyridine aqua) rhodium (III):

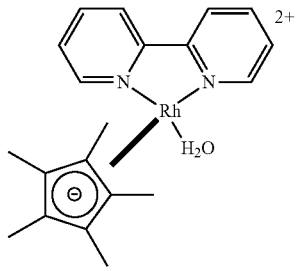

$RhMed_{ox}$

In various embodiments the electrically driven redox mediator is reduced by the addition of two electrons and therefore is an electrically driven reduced redox mediator. In various embodiments the electrically driven redox mediator is reduced at the surface of the cathode. Electrons at a higher energy at the surface of the cathode cross into a lower energy level in the redox mediator. An example of an electrically driven reduced redox mediator includes (pentamethylcyclopentadienyl-2,2'-bipyridine hydrogen) rhodium (I).

(Pentamethylcyclopentadienyl-2,2'-bipyridine hydrogen) rhodium (I) can be obtained through equilibrium through the bridge cleavage of $[Cp^*RhCl_2]_2$ with the relevant bipyridine in methanol. A suspension thereof in methanol goes on addition of the bipyridines in solution in which the complexes are precipitated with Ether. The complexes fall in the form of [Cp*Rh(2,2'-bipyridine) Cl]Cl MeOH x=0.1 atm. by the crystallization from $MeOH/Et_2O$.

Exemplary systems using RhMed, and two electrodes includes the system described in Vuorilehto et al., "Indirect electrochemical reduction of nicotinamide coenzymes", Bioelectrochemistry 65 (2004) (hereinafter "Vuorilehto"), the disclosure of which is incorporated herein by reference in its entirety. In Vuorilehto, RhMed, and two electrodes are operated in an electrochemical cell to drive the reduction of $NADP^+$ into NADPH.

In various embodiments of the instant disclosure the electrically driven reduced redox mediator acts on the nicotinamide co-enzyme to reduce an oxidized form of the nicotinamide co-enzyme which is then further oxidized by the enzyme catalyzing the reduction. For example, the electrically driven redox reaction involves a 2 electron transfer to co-enzyme molecules (co-factors), each of which, in turn become co-factors for the NLP-hydrogenase enabling reduction of solution protons to molecular hydrogen.

In some embodiments, at least one nicotinamide driven enzyme of the NLP is a membrane associated hydrogenase. The wordings "membrane associated hydrogenase," "membrane bound hydrogenase," or "MBH" as used herein indicate a hydrogenase having a structure that is suitable for attachment to or association with a biological membrane or biomembrane. The term "hydrogenase" as disclosed herein indicates an enzyme that is capable of promoting formation and/or utilization of molecular hydrogen via a nicotinamide co-enzyme, and in particular is capable of catalyzing the conversion of protons to molecular hydrogen (herein also hydrogen production reaction). Hydrogenases as included herein include various oxidoreductase enzymes such as hydrogen dehydrogenase (EC 1.12.1.2; $H_2+NAD^+ \rightleftharpoons H^++NADH$), hydrogen dehydrogenase NADP+ (EC 1.12.1.3; $H_2+NADP^+ \rightleftharpoons H^++NADPH$); Hydrogenase NAD+, ferredoxin (EC 1.12.1.4; 2 $H_2+NAD^++2$ oxidized ferredoxin $\rightleftharpoons 5H^++NADH+2$ reduced ferredoxin).

More particularly, exemplary [Ni/Fe] hydrogenases can be comprised in the MBH-NLP herein disclosed, with unique and attractive properties for bioenergy production are provided by [Ni/Fe/Se]-hydrogenase from *Desulfomicrobium baculatum*, (See e.g. Goldet et al. Am. Chem. Soc. 2008, 13 (40) 13410-13416)(which is oxygen tolerant), the MBH from *Allochromatium vinosum* (see e.g. Cracknell et al. J. Amer. Chem. Soc. 2007, 130, 424-425)(which as a very high rate of hydrogen oxidation, comparable to that of platinum), the MBH from *Ralstonia* species has been shown to produce hydrogen in the presence of oxygen (see e.g. Goldet et al. J. Amer. Chem. Soc. 2008, 130, 1 1106-1113) and a bidirectional heteromultimeric hydrogenase of *Klebsiella pneumoniae* able to bind soluble co-factors (see e.g. Vignais et al. Chem. Rev. 2007, 107, 4206-4272).

An additional example of [Ni/Fe] hydrogenase is the membrane hydrogenase of *Pyrococcus furiosis* (PF-MBH). PF-MBH has ratio of $H_2$ evolution to $H_2$ oxidation activity of approximately 2,350. The enzyme operates optimally at 90 degrees C. in washed membranes. Purified PF-MBH contains 2 main subunits ($\alpha$ and $\beta$) in 1:1 ratio with a molecular mass of about 65 kDa. The protein contains about 1 Ni and 4 Fe atoms per mole. The a subunit contains the [Ni/Fe] active site. The open reading frames in the operon which encode the active site have sequence homology to MBH[Ni/Fe] complexes from *Methanosarcina barkeri, Escherichia coli*, and *Rhodospirillum rubrum*.

In some embodiments, the hydrogenase is a [Ni/Fe] hydrogenase from any of *Allochromatium vinosum, Methanosarcina barkeri, Escherichia coli*, and *Rhodospirillum rubrum Desulfomicrobium baculatum* and *Ralstonia* species. In some embodiments, the hydrogenase is a [Ni/Fe] hydrogenase from *Pyrococcus furiosus*.

A skilled person would be able to identify additional membrane associated hydrogenases suitable to be included in the nanolipoprotein particles herein described upon reading of the present disclosure.

Assembly of MBH-NLPs can be detected using techniques identifiable by the skilled person upon reading of the present disclosure that include Atomic Force Microscopy (AFM) or Transmission Electron Microscopy. The insertion of MBH in NLPs can be inferred from a comparison of size between empty NLP and supposed MBH NLP using: Size Exclusion Chromatography (SEC), Native and denaturing Poly-Acrylamide Gel Electrophoresis (PAGE), and a height comparison in AFM.

The term "detect" or "detection" as used herein indicates the determination of the existence, presence or fact of an MBH, MBH-NLP and/or related activities in a limited portion of space, including but not limited to a sample, a reaction mixture, a molecular complex and a substrate. A detection is "quantitative" when it refers, relates to, or involves the measurement of quantity or amount of the MBH, MBH-NLP and/or related activities (also referred to as quantitation), which includes but is not limited to any analysis designed to determine the amounts or proportions of the MBH, MBH-NLP and/or related activities. Detection is "qualitative" when it refers, relates to, or involves identification or a quality or kind of the MBH, MBH-NLP and/or related activities in terms of relative abundance to another MBH, MBH-NLP and/or related activities, which is not quantified.

In several embodiments, an MBH-NLP can contain a mass ratio of between 1:1 and 20:1 of lipid to scaffold protein. The ratio of scaffold protein to MBH can be varied from 1:0.025 to 1:1. When proteins other than hydrogenase are used, ratios of scaffold protein to MBH can be varied between 1:0.01 to 1:1. The concentration of membrane forming lipid can be varied from 0.1 to 20 mg/per mL. A skilled person will be able to identify the appropriate ratios based on the size and dimension (lipid to scaffold protein ratio) and the protein-protein interactions (scaffold protein to MBH ratio) characterizing the MBH of choice.

Functionality of the MBH comprised in the NLP can be detected by several techniques that are based on the detection of performance of any reaction that is associated to a functional MBH of interest. Exemplary techniques to detect hydrogenase activity include detection of hydrogen production catalyzed by an MBH-NLP and detection of conversion of molecular hydrogen to protons catalyzed by the MBH-NLP. Hydrogen production can be in particular quantitatively or qualitatively detected by measuring $H_2$ evolution in a gas chromatograph after incubating the MBH-NLP with a suitable electron donor, such as nicotinamide co-enzymes in a buffered aqueous solution, wherein the solution can be anaerobic. Additional techniques to detect hydrogenase activity are identifiable by a skilled person upon reading of the present disclosure.

In several embodiments, the hydrogenase activity detected for MBH-NLPs is expected to be comparable with the activity of the hydrogenase in the crude MBH. In particular in some embodiments the hydrogenase activity can include a range of activities between ~7.5 nmol hydrogen produced per min per mg protein and ~600 umol hydrogen produced per min per mg protein (see Jed O. Eberly and Roger L. Ely *Critical Reviews in Microbiology*, 34:117-130, 2008).

In several embodiments, the MBH-NPL herein described can be used in method to perform a chemical reaction catalyzed by the MBH, and in particular, in embodiments where the MBH is a metalloenzyme derived from an organism, to perform in vitro a chemical reaction that can be performed by the hydrogenase in the organism.

In some embodiments, the chemical reaction catalyzed by the MBH-NLP is hydrogen production, and the NLPs incorporated with MBH can be used to catalyze production of hydrogen starting from an organic substrate, that is processed to provide proteins that are then converted to molecular hydrogen by the MBH-NLPs.

In particular, the protons can be present in any aqueous medium and be provided to the MBH via electron donors also present in the reaction mixture such as a reduced nicotinamide co-enzyme or nicotinamide co-factor.

In several embodiments, hydrogen production can be optimized by varying the temperature of the reaction vessel between about 25 degrees C. and about 95 degrees C. depending on the optimal turnover rate for the type of MBH used. Additionally, variables such as mass transport, solution pH, ionic strength, hydrogenase concentration, co-factor and/or electron donor and/or reducing agent concentration oxygen content reduced, and hydrogen content can be optimized. Proteins other than hydrogenase can be used and the temperature used in the cell would be dependent on the sensitivities of the alternative proteins as understood in the art.

In various embodiments wherein the nicotinamide driven enzyme is comprised in an NLP the MBH-NLP can be immobilized via a chemical linkage to the NLP lipid or a chemical linkage through the apolipoprotein. The chemical linkage through the lipid can be provided, for example, using a biotin labeled lipid and attaching the protein avidin to the surface of the support. Additionally, His-tagged ligands can be attached directly to NLPs containing Ni-lipids or to NiNLPs. The latter is described in detail in Fischer et al. Bioconjugate Chem (2010) 21: 1018-1022. Ligands can also be attached to the NLP through other chemical linkages, e.g. through ε-amino groups from lysine residues and support functionalized with carboxylic acid groups forming an amide bond.

Exemplary living organisms for the MBH-NLPs of the present disclosure include but are not limited to several prokaryotes such as *Allochromatium vinosum, Methanosarcina barkeri, Escherichia coli*, Rhodospirillum *rubrum, Desulfomicrobium baculatum, Ralstonia* species, *Pyrococcus furiosus, C. hydrogenoformans, Rubrivax gelatinosus, Methanothermobacter thermoautotrophicus, Methanothermobacter marburgensis*, and *Thermoanaerobacter tengcongensis.*

The MBH-NLPs (135) (represented as stars in FIG. 1, but not indicative of their actual shape) are immobilized on packed graphite particles (115) for catalytic reaction to produce molecular hydrogen from the water in the buffer solution. In the present disclosure, $NADP^+$ is reduced using an electrochemical cell of FIG. 1, and NADPH can be used as a co-factor for NLP hydrogenase. 2 NADPH molecules are enzymatically converted to 2 $NADP^+$ molecules with concomitant reduction of two $H^+$ (protons) to $H_2$ (molecular hydrogen).

By coupling the NADPH regeneration process with membrane-bound hydrogenase (MBH) NLP constructs, a method for enzymatic hydrogen production can be performed. Such method can be used to generate hydrogen gas inexpensively and in a manner that does not rely on petroleum derivatives. Further, the reagents involved are recycled during the hydrogen production while the electrical power required is rather small, for example, a voltage of about 100-500 mV can be used. Therefore, individual, self-sustaining generating unit are possible. Such units can also be deployed in remote areas.

Possible applications comprise the reduction of unsaturated hydrocarbons from oil refinery (therefore having a higher octane fuel production); the production of ammonia for fertilizers for agriculture; the production of methanol by $CO_2$ reduction; and direct use of hydrogen as a transportation fuel.

As described in the present disclosure, 'soft' lipid nanoparticle-hydrogenase molecular constructs adsorbed onto a 'hard' carbon-based electrode support material allows the hydrogenase enzymes to adopt a more native-like conformation within a biomimetic membrane scaffold matrix, maximizing both stability and activity of isolated enzymes.

In some embodiments, graphite beads used as support for the enzymatic hydrogen production as described above can be substituted for a three-dimensional porous graphitic carbon membrane matrix. The rhodium catalyst, other noble metals/Pt group metals or other types of catalysts, can be immobilized onto the graphene matrix in order to enhance red/ox transformation of co-factors through mesoscale mass transport engineering. Such structure can also be used for optimizing biological hydrogen production through enzymes, by screening stabilized microbial membrane associated hydrogenases to discover optical enzymes for a specific application.

A three-dimensional graphitic carbon material can be fabricated to have a high surface area and a controlled pore structure. A fast reaction rate for the production of hydrogen through enzymes is attributable to rapid adsorption and distribution of the reactants within the pores of a matrix, without the limitation of diffusive transport. A three-dimensional mesoporous carbon network structure can have monodisperse nanometer-sized pore diameters, e.g. 30-200 nm, with channels and struts fully interconnected, thereby exhibiting diffusivity that is greater than other mesoporous structures. Additionally, the mesoporous structure can act as an electrode as graphitic carbon material which conducts electricity. Nanoparticles can be incorporated within the porous channels of the mesoporous structure.

The increase in surface area and the diffusion of reactants through the porous media can increase the number of available reaction sites, increasing the overall reaction rate.

For example, a mesoporous graphitic carbon material structures can be fabricated according to the methods described in Scientific Reports (2103) 3:1788, "Three-Dimensional Graphene Nano-Networks with High Quality and Mass Production Capability via Precursor-Assisted Chemical Vapor Deposition" the disclosure of which is incorporated herein by reference in its entirety.

The mesoporous structure can be incorporated in an electrochemical cell for example, referring to FIG. 1, as a substitute for the beads (115).

In some embodiments herein described, the system can also comprise an oxygen removal system configured to remove dissolved oxygen from the buffer solution prior to introduction into the electrochemical cell. One method of removing the oxygen is to bubble argon gas through the buffer in the solution reservoir (310) (e.g. using a bubbler tube with a fitted glass egress). In some embodiments, the oxygen removal system comprises an argon gas bubbler connected to the solution reservoir. In some embodiments, the method can also comprise removing dissolved oxygen from a reagents solution, such as a buffer solution, prior to the flowing the solution through the electrochemical flow cell, with techniques to displace adventitious gases from the solution are identifiable by a skilled person.

In some embodiments hydrogen production or target molecule reduction can be performed by providing an electrochemical flow cell herein described comprising an electrically conductive porous supporting structure connected to a plurality of nanolipoprotein particles, wherein said nanolipoprotein particles holding the nicotinamide driven membrane enzyme; providing a voltage across the electrochemical flow cell; and introducing an aqueous solution containing nicotinamide co-enzyme and electrically driven redox mediator into the electrochemical flow cell. In some embodiments the method can further comprise collecting the reduced target molecule from the electrochemical flow cell.

In some embodiments, a system herein described can be provided by providing an electrochemical flow cell herein described and connecting a nanolipoprotein particle herein described to the electrically conductive supporting structure. In particular in some embodiments, the system can be provided by connecting a first set of conduits from a buffer solution reservoir to the electrochemical flow cell; connecting a second set of conduits from the electrochemical flow cell to a gas container; and connecting the first and second electrode to a power supply.

Overall, achieving inexpensive hydrogen production via hydrogenase-mediated proton reduction is possible and can be characterized as being comprised of three components: 1) a simple, inexpensive way of providing electrons to an overall system, 2) identifying and leveraging the optimal hydrogenase(s), and, 3) coupling with NLP platform technology to concentrate presentation of multiple enzymes, i.e. a 'force multiplier' capability. In concert, these three elements form an end-to-end biological hydrogen-generation approach that could potentially deliver hydrogen at production cost in the range of $1-3/kg.

EXAMPLES

The methods and systems herein disclosed are further illustrated in the following examples, which are provided by way of illustration and are not intended to be limiting.

In the following examples, a further description of the nanoparticles methods and systems of the present disclosure is provided with reference to applications wherein the hydrogenase is the membrane hydrogenase of *P. Furiosus* (PF-MBH). A person skilled in the art would appreciate the applicability of the features described in detail for nanoparticles comprising membrane associated hydrogenase from *P. Furiosus* to nanoparticles including other membrane associated hydrogenases as defined herein. In particular, the examples of nanoparticles methods and system herein provided although related to hydrogen production through nanolipoprotein particles comprising membrane associated hydrogenases also provide guidance to a skilled person to obtain nanolipoprotein particles able to catalyze other chemical reactions as defined herein.

Example 1

Preparation of MBH-NLPs

Figure 5:
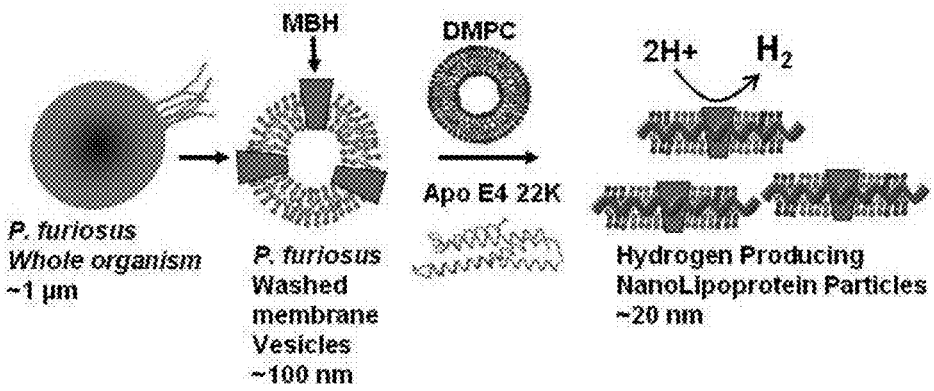
FIG. 5 shows a schematic illustration of a process to provide a MBH-NLP according to an embodiment herein disclosed.

Nanolipoprotein particles comprising membrane associate hydrogenases according to the approach schematically illustrated in FIG. 5.

In particular, FIG. 5 provides an overview of the process used to assemble MBH-NLPs. *P. furiosus* cells were first lysed and cellular membranes were separated and washed using centrifugation, forming insoluble membrane fragments and vesicles.

More particularly, preparation of washed membranes from *Pyroccocus furiosus* was performed as follows:

*P. furiosus* (DSM 3638) was grown in a 600 liter fermenter at 90° C. as previously described. Fifty grams of *P. furiosus* cells were osmotically lysed in 50 mM Tris, 2 mM sodium dithionite (DT), pH 8 and centrifuged at 50,000×g for 45 minutes. The resulting pellet was re-suspended in the same buffer, and centrifuged in this manner an additional two times, and brought to a final re-suspended volume with 5 mL of the same buffer. The sample was then anaerobically frozen in liquid nitrogen and sealed under argon.

A suspension of the membrane fragments was added to synthetic phospholipid 1,2-Dimyristoyl-sn-Glycero-3-Phosphocholine (DMPC), Apo E422k and cholate, a surfactant, using a cholate concentration above the critical micelle concentration (20 mM) in presence of a scaffold protein. The scaffold protein used was a truncated helical amphiphilic apolipoprotein E with a mass 22 kD (Apo E422k).

The phospholipid 1,2-Dimyristoyl-sn-Glycero-3-Phosphocholine (DMPC) was purchased from Avanti Polar Lipids, Inc. Sodium cholate and sodium DT were used as received from Sigma-Aldrich. The scaffold protein Apo E4 22k was produced according to published procedures. Tris-Buffered Saline (TBS) was composed of 10 mM Tris, 0.15M NaCl, 0.25 mM EDTA, and 0.005% Sodium Azide, pH 7.4. All solutions used were degassed and maintained under a positive pressure of argon prior to use.

The components were thermally cycled above and below the transition temperature of DMPC, followed by removal of excess DMPC and cholate by dialysis against buffer.

The NLPs were then separated from unincorporated proteins and lipids and were ready to be tested for hydrogen production.

Example 2

Identification and Characterization of MBH/NLPs: Size Exclusion Chromatography MBH/NLPs were produced according to a procedure exemplified in example 1. The particles were then separated from unincorporated free proteins and lipids using size exclusion chromatography (SEC).

Native and denaturing polyacrylamide gel electrophoresis of the SEC fractions was carried out according to published procedures (see Blanchette, Journal of Lipid Research 2008, 49, (7), 1420-1430; and Chromy, B. A., Journal of the American Chemical Society 2007, 129, 14348-14354).

Figure 6:
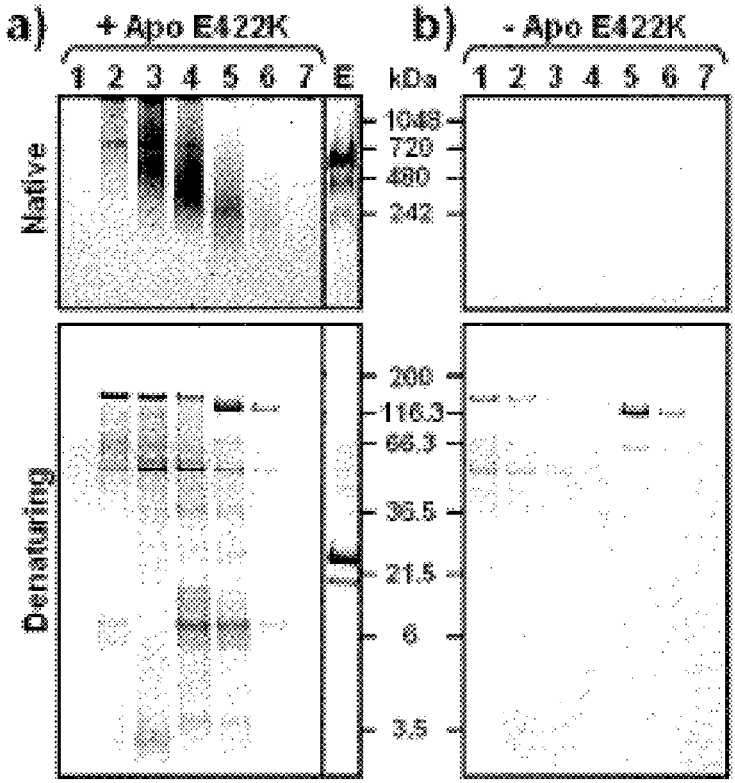
FIG. 6 shows identification of MBH-NLPs according to an embodiment herein disclosed. In particular, Panel a) shows exemplary native (top) and denaturing (bottom) polyacrylamide gel electrophoresis of sequential fractions collected after size exclusion chromatography (SEC) of an Assembly "A" formed by an NLP, a hydrogenase, and a scaffold protein). The lane marked E corresponds to an unpurified "empty" NLP assembly. The bands in lanes 2-5 in the native gel in Panel a) are characteristic of NLP bands, both according to the molecular weight standards on the gel, as well as the SEC elution time. Panel b) shows exemplary native (top) and denaturing (bottom) polyacrylamide gel electrophoresis of sequential fractions collected after size-exclusion chromatography (SEC) of an Assembly "B" formed by a control formed by membrane lipids and hydrogenase (-scaffold protein). The native gel in b) contains no NLP bands, consistent with the absence of scaffold protein in the assembly mixture.

The results illustrated in FIG. 6 shows representative native and denaturing polyacrylamide electrophoresis gels loaded with three assemblies. Assembly "A" contained all components required for incorporation of MBH into NLPs: lipid, surfactant, Apo E 422k, and MBH-containing membranes. Assembly "B" excluded the structure-directing scaffold protein, Apo E422k, from the assembly mixture and therefore served to elucidate the effects of NLP incorporation on MBH solubility, particle size, and hydrogenase activity.

Assembly "E" contained "empty" NLPs, which were prepared in the absence of MBH-containing membranes for comparison of particle size distributions to those present in MBH-NLPs.

FIG. 6A shows both native (top) and denaturing (bottom) polyacrylamide gels loaded with samples from SEC fractions resulting from MBH-NLP assembly "A". Lanes 1-7 are from 1 mL SEC fractions collected at a flow rate of 0.5 mL/minute. Fraction collection began 15 minutes after injection (lane 1).

The void volume of the column was 8 mL (16 minutes) using blue dextran as the marker. The broad smears in lanes 2-5 of the native gels are characteristic of NLP complexes. However, fractions 2, 3, and 4 appear to contain particles of larger size than the empty NLPs in lane E consistent with a population of NLPs with *P. furiosus* membrane proteins incorporated into the particles. The corresponding denaturing SDS gel lanes (FIG BA bottom) shows bands consistent with *P. furiosus* membrane proteins, indicating incorporation of *P. furiosus* membrane proteins, including those that contribute to hydrogenase activity, into the NLP-like particles.

FIG. 6B shows SEC purification fractions of assembly "B", where lanes 1-7 represent the same elution times as those in lanes 1-7 in FIG. 6A. The native gel contained only very low intensity bands in fractions 1, 2, and 3 indicating that no significant concentration of particles in the size range of NLPs was present, consistent with the fact that no structure-directing scaffold protein was added. The corresponding denaturing SDS gels show protein bands consistent with *P. furiosus* membrane proteins in every fraction. Combined, these gel results show that *P. furiosus* membrane proteins were eluted from the SEC column, but not in the form of NLPs. The lower intensity of the bands in FIG. 6B can be due in part to sample filtration prior to SEC purification, which removed protein-containing fragments larger than approximately 200 nm in the assemblies. With no scaffold protein present to break up and solubilize the vesicles, assembly "B" can have contained insoluble or large particles which were removed during the filtration step. It is important to note that assembly "A" fractions containing substantial protein content eluted at later times from the SEC column compared to assembly "B" fractions, and were thus smaller in size. This discrepancy in elution time is another indication that addition of the Apo E422k scaffold protein directed the formation of smaller particles compared to those present in the assembly lacking Apo E422k.

Figure 7:
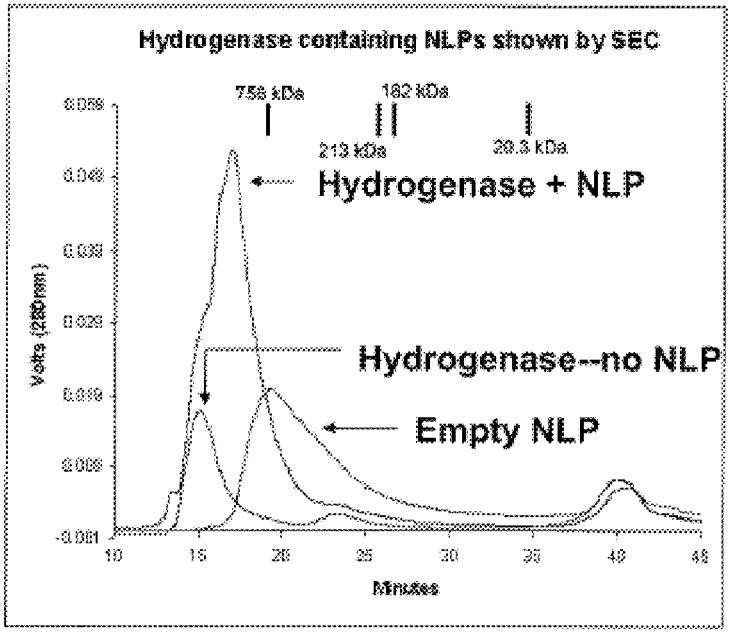
FIG. 7 shows a diagram illustrating an exemplary identification of the nanolipoprotein particles of the present disclosure, according to an embodiment herein disclosed. In particular.

An additional illustration of identification and characterization of MBH/NLP is illustrated in FIG. 7, which shows a size exclusion chromatograph containing 3 peaks. The peaks correspond to components from a crude hydrogenase-NLP assembly that eluted at distinct times and were separated on the basis of size. The chromatograph shows a main peak at about 18 minutes which elutes after the crude membrane peak (hydrogenase-no NLP at 15 minutes) and before the "empty" NLP peak (20 minutes). These results indicate that the assembly mixture containing both crude PF membrane suspension, and larger in size than the "empty" NLPs. The results are consistent with the successful assembly of NLPs containing membranes from *P. furiosus*.

Example 3

Characterization of MBH/NLPs: Atomic Force Microscopy

Nanolipoprotein particles were produced and separated from unincorporated free proteins and lipids using size exclusion chromatography (SEC) as exemplified in Example 2. The resulting fractions were characterized for size and homogeneity by native and denaturing gel electrophoresis and atomic force microscopy (AFM).

In particular, gel electrophoresis of the SEC fractions from assembly "A" support the formation of NLPs containing proteins from the *P. furiosus* solubilized membranes. In order to determine the morphology and size distribution of these particles, the SEC fractions were characterized with AFM. Atomic force microscopy (AFM) was carried out according to published procedures. (See e.g. Blanchette et. al. *J. of Lipid Res.* 2008, 49, (7), 1420-1430; Chromy, B. A. et. al. *J. of Amer. Chem. Soc.* 2007, 129, 14348-14354).

Figure 8:
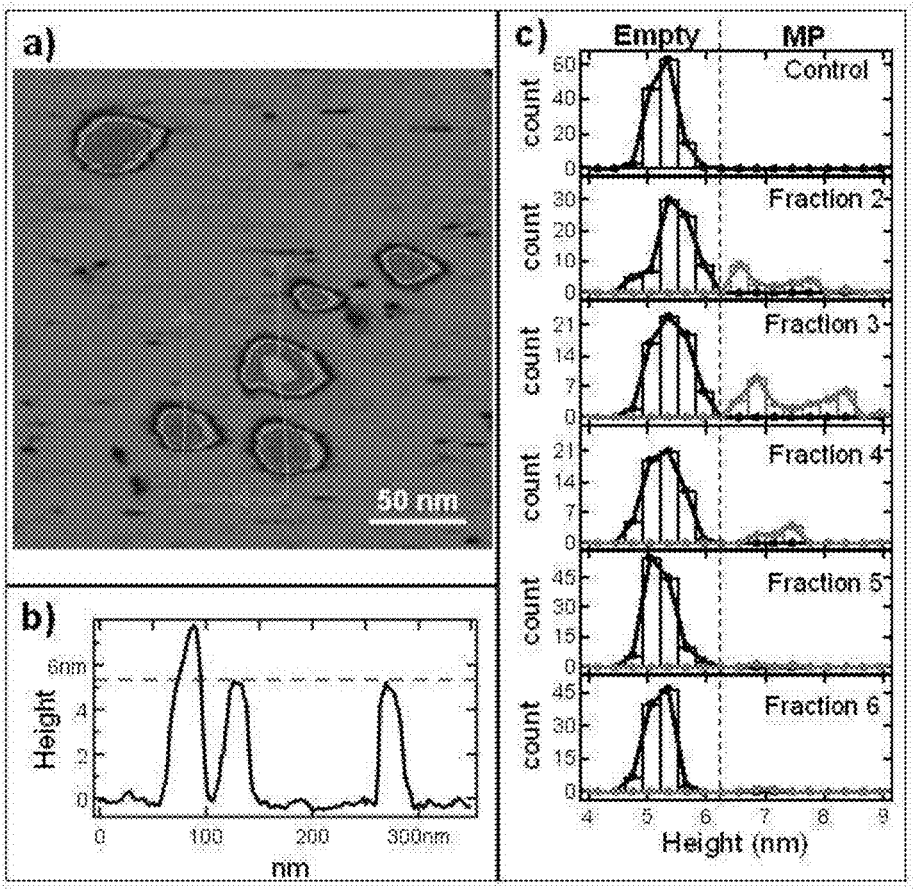
FIG. 8 shows identification of nanolipoprotein particles of the present disclosure according to an embodiment herein disclosed. In particular, panel a) shows an AFM (atomic force microscopy) image of NLPs from fraction 3 of assembly "A" shown in FIG. 2. Light grey regions are indicative of particles that are higher than 6.5 nm. Panel b) shows a diagram illustrating height difference between two NLPs from the cross section with line trace shown in panel a). Panel c) shows histograms of heights observed for "empty" NLP (assembled without *P. furiosus* membrane) and size exclusion fractions 2-6 from Assembly "A" of FIG. 2, assembled with *P. furiosus* membrane.

The results are illustrated in FIG. 8. In particular FIG. 8A shows a representative AFM image of fraction 3 from assembly. Round, discrete disk-shaped particles on the order of 20-30 nm in diameter are observed with varied height profiles. The heights of the particles are depicted as variations in the shade of green in the center of each particle. Cross sections of two representative particles (following the superimposed yellow line) are shown in FIG. 8B. As shown by the height profile, the lighter regions correspond to heights greater than 6.5 nm. Fractions 2, 3, and 4 were found by AFM to consist of nanometer scale discoidal particles with some fraction of the particles determined to be higher than the NLPs in an empty assembly. The height profiles of these fractions are depicted in the histograms of NLP height in FIG. 8C. The top histogram represents the height distributions of empty NLPs, displaying a Gaussian distribution with a mean height of 4.9+/−0.2 nm, consistent with the height of a lipid bilayer. In contrast, assembly "A" fractions 2, 3, and 4 contain two populations of NLPs: those which have height profiles very similar to those of the empty NLPs and a population of particles which have significantly "taller" height profiles than the empty NLP subset.

Because *P. furiosus* membranes have associated membrane proteins, including MBH, which can both span and extend beyond the cell membrane, the subset of taller NLPs likely contains MBH.

Example 4

Immobilization of MBH/NLP

In an exemplary procedure the NLP-hydrogenase constructs is expected to adsorb non-specifically to the graphite material. In particular, a solution of NLP-hydrogenase in TBS will be passed through a pad of activated carbon (1 cm×1 cm), eluate collected and tested for $H_2$ producing activity. The difference in activity from the starting mixture will indicate the amount of bound NLP-hydrogenase. Bound NLP-hydrogenase materials will be tested for $H_2$ producing activity.

Example 5

Hydrogen Production by an Electrically Driven NADP/NADPH Regeneration

Application of an external current to an appropriately designed electrochemical flow cell device is expected to enable the chemistry shown below:

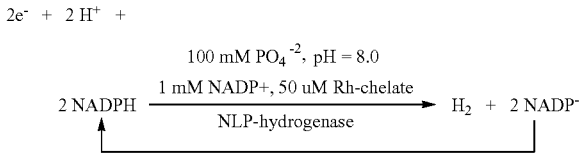

A small amount (a few hundred millivolts) of electricity can be used to reduce oxidized NAD(P)+ co-factor to NAD(P)H in the presence of rhodium catalyst, and thus make reduced co-factor available to NLP-hydrogenase. The NLP-hydrogenase nanoconstructs are anticipated to be active at room temperature and can produce molecular hydrogen by reducing protons using nicotinamide (NAD) cofactors as the biological electron donor system. This system of NAD co-factor regeneration can be integrated with an innovative electrochemical flow-cell design. The latter could contain a chelated-rhodium catalyst associated with a conductive 3D porous graphene membrane matrix that indirectly facilitates NAD co-factor recycling making enzyme-mediated proton reduction to molecular hydrogen possible. The hierarchical graphene-based conductive catalytic support enhances red/ox transformation of co-factors through mesoscale mass transport engineering.

NLP formation can be carried out in the presence of a cell membrane preparation containing a functional membrane bound hydrogenase (MBH) enzyme of *Pyrococcus furiosus* (Topt 100° C.) forming nanoparticles containing a stable active enzyme. An electrical current can be used in situ to generate NADPH, which can serve as an electron donor for a hydrogenase-NLP construct. A rhodium-based red-ox mediator can be used to enable NADPH generation; a reduced version of the former can be generated by electrochemical reduction. An example of this system is shown in FIG. 1, and can be produced with, for example, stainless steel plates covered with carbon foil, glassy carbon spheres and/or 3-D graphene mesoporous carbon-based scaffold material, and an ion exchange membrane, with potential across the cell maintained by a potentiometer.

Example 6

Figure 9:
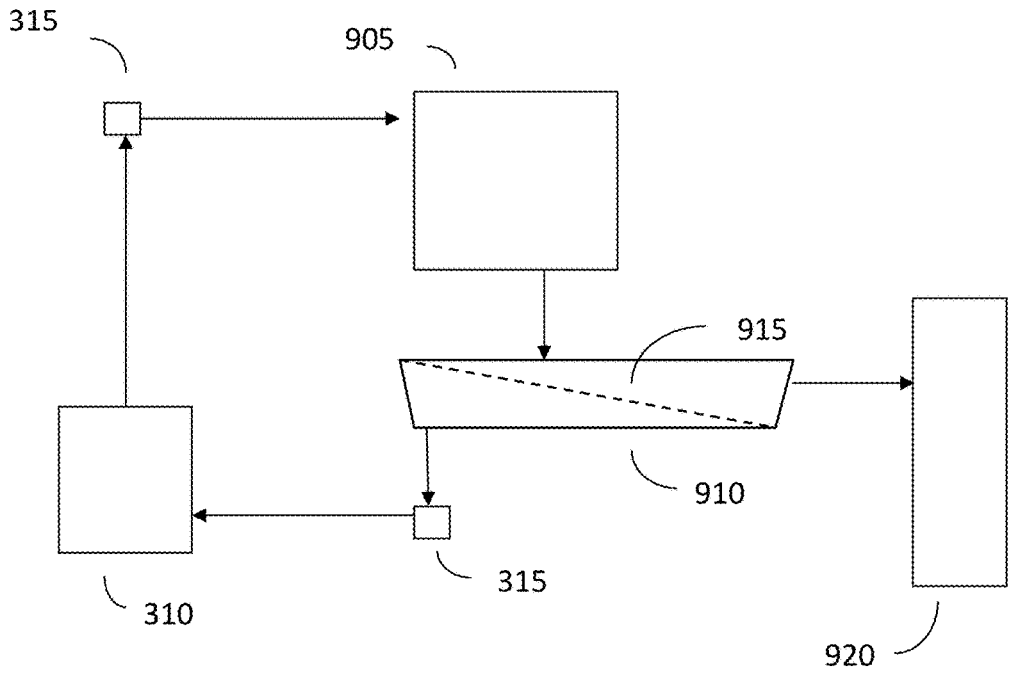
FIG. 9 illustrates an exemplary system incorporating an electrochemical flow-cell with a non-gaseous product.

Production of Solid or Liquid Target by an Electrically Driven NADP/NADPH Regeneration FIG. 9 illustrates an exemplary system incorporating an electrochemical flow-cell with a non-gaseous product. For example, a non-gaseous product flow-cell (905) can be connected to a buffer solution reservoir (310) through pumps (315) just as provided in FIG. 3. However, in the case of a non-gaseous flow cell (905), the combination of buffer solution and product are, for example, gravity deposited into a separation chamber (910) that contains a membrane (915) or sieve that separates the buffer solution from the product. The product can then be removed from the chamber (910) and placed in storage (920). Examples of removal methods include intermittently or continuously scraping the product from the membrane, membrane replacement, membrane washing, and shaking the product loose from the membrane. The nature of the membrane (915) and the storage (920) depends on the nature and properties of the product.

In summary, in several embodiments, methods and systems for hydrogen production or production of a reduced target molecule are described, wherein a nicotinamide co-factor dependent membrane hydrogenase or a nicotinamide co-factor dependent membrane enzyme presented on a nanolipoprotein adsorbed onto an electrically conductive supporting structure, which can preferably be chemically inert, is contacted with protons or a target molecule to be reduced and nicotinamide cofactors in presence of an electric current and one or more electrically driven redox mediators.

According to a first aspect, a system for hydrogen production is described, the system comprising a nanolipoprotein particle presenting a nicotinamide co-factor dependent membrane hydrogenase, at least two opposing electrodes, an electrically conductive supporting structure between said first electrode and second electrode, and, wherein the nanolipoprotein particles are immobilized to the electrically conductive supporting structure.

In some embodiments of the first aspect, the system further comprises a voltage generator, connected to the first and second electrode. In some of those embodiments the voltage generator can be configured to create an electric potential of 500 mV between the first and second electrodes.

In some embodiments of the first aspect, the system can further comprise an ion exchange membrane between the electrically conductive supporting structure and the second electrode.

In some embodiments of the first aspect, the electrically conductive supporting structure can be chemically inert.

In some embodiments of the first aspect, the electrically conductive supporting structure can be an electrically conductive porous supporting structure. In some of those embodiments, the electrically conductive porous supporting structure supporting structure comprises graphite beads having a diameter less than or equal to 400 μm. In some embodiments, the electrically conductive porous supporting structure is a mesoporous structure. In some embodiments, the mesoporous structure comprises a three-dimensional mesoporous carbon network structure which can further comprise graphitic carbon material. In some embodiments the mesoporous structure is a graphitic carbon aerogel.

In some embodiments of the first aspect, the system further comprises an oxygen removal system configured to remove dissolved oxygen from the buffer solution. The oxygen removal system can further comprise an argon gas bubbler.

According to a second aspect, a method to produce hydrogen is described, the method comprising combining protons, a nicotinamide co-factor and a nicotinamide co-factor dependent membrane hydrogenase presented on a nanolipoprotein particle immobilized on an electrically conductive supporting structure for a time and under condition to allow hydrogen production in presence of an electrical current and of an electrically driven redox mediator.

In some embodiments of the second aspect, the nicotinamide co-factor dependent membrane hydrogenase is a [Ni/Fe] hydrogenase from *Allochromatium vinosum, Methanosarcina barkeri, Escherichia coli*, and *Rhodospirillum rubrum Desulfomicrobium baculatum* and *Ralstonia* species. In some embodiments, the nicotinamide co-factor dependent membrane hydrogenase is a [Ni/Fe] hydrogenase from *Pyrococcus Furiosus*.

In some embodiments of the second aspect, the nicotinamide co-factor can be nicotinamide adenine dinucleotide phosphate.

In some embodiments of the second aspect, the redox mediator can comprise a metallic redox mediator.

In some embodiments of the second aspect, the combining can be performed by contacting a solution comprising the protons, the nicotinamide co-factor and the electrically driven/recycled redox mediator with the electrically conductive supporting structure in presence of the electric current.

In some embodiments of the second aspect, the electric current is less than 10 milliamps, even at 500 mV.

According to a third aspect, a system for hydrogen production is described, the system comprising a nicotinamide co-factor dependent membrane hydrogenase presented on a nanolipoprotein particle; and an electrochemical flow cell comprising a first electrode and a second electrode, an electrically conductive supporting structure wherein the electrochemical flow cell is configured to receive a solution in a space between the first electrode and the second electrode, the electrically conductive supporting structure is configured to immobilize the nicotinamide co-factor dependent membrane hydrogenase presented on the nanolipoprotein particle and to be exposed to the solution in the electrochemical flow cell.

In some embodiments of the third aspect, the electrochemical flow cell comprises the nanolipoprotein particles herein described immobilized on the electrically conductive supporting structure.

In some embodiments of the third aspect, the electrochemical flow cell can further comprise an ion exchange membrane between said first and second electrodes.

According to a fourth aspect, a method to produce a reduced target molecule is described, the method comprising: providing a solution containing protons, nicotinamide co-factors and one or more electrically driven redox mediators into the electrochemical flow cell of the system of the third aspect; and applying a voltage across the first electrode and the second electrode of the electrochemical flow cell.

In some embodiments of the fourth aspect, the method can further comprise capturing hydrogen gas generated in the electrochemical flow cell.

In some embodiments of the fourth aspect, the method can further comprise removing dissolved oxygen from the solution prior to the providing the solution through the electrochemical flow cell.

According to a fifth aspect, a method to produce hydrogen is described, the method comprising: contacting protons, a nicotinamide co-factor and a nicotinamide co-factor dependent membrane hydrogenase presented on a nanolipoprotein particle for a time and under condition to allow hydrogen production in presence of an electrical current and of an electrically driven redox mediator.

In some embodiments of the fifth aspect, the electrically driven redox mediator can be a metallic electrically recycled redox mediator.

In some embodiments of the fifth aspect, the electrically reduced redox mediator can be (pentamethylcyclopentadienyl-2,2'-bipyridine hydrogen) rhodium (I).

In some embodiments of the fifth aspect, the nicotinamide co-factor can be nicotinamide adenine dinucleotide phosphate.

In some embodiments of the fifth aspect, the nicotinamide co-factor dependent membrane hydrogenase can be a [Ni/Fe] hydrogenase from *Allochromatium vinosum, Methanosarcina barkeri, Escherichia coli*, and *Rhodospirillum rubrum Desulfomicrobium baculatum* and *Ralstonia* species. In some embodiments, the nicotinamide co-factor dependent membrane hydrogenase can be a [Ni/Fe] hydrogenase from *Pyrococcus furiosus*.

According to a sixth aspect, a system for hydrogen production is described, the system comprising: a nicotinamide co-factor, a nicotinamide co-factor dependent membrane hydrogenase presented on a nanolipoprotein particle and an electrically driven redox mediator for simultaneous combined or sequential use together with an arrangement providing the electric current according to the method of the fifth aspect.

In some embodiments of the sixth aspect, the electrically driven redox mediator can be a metallic electrically recycled redox mediator, and in particular the electrically reduced redox mediator can be (pentamethylcyclopentadienyl-2,2'-bipyridine hydrogen) rhodium (I).

In some embodiments of the sixth aspect, the nicotinamide co-factor is nicotinamide adenine dinucleotide phosphate. In some of those embodiments, the nicotinamide co-factor dependent membrane hydrogenase is a [Ni/Fe] hydrogenase from *Allochromatium vinosum, Methanosarcina barkeri, Escherichia coli*, and *Rhodospirillum rubrum Desulfomicrobium baculatum* and *Ralstonia* species. In particular, in some embodiments, the nicotinamide co-factor dependent membrane hydrogenase can be a [Ni/Fe] hydrogenase from *Pyrococcus furiosus*.

A number of embodiments of the disclosure have been described. Nevertheless, it will be understood that various modifications may be made without departing from the spirit and scope of the present disclosure. Accordingly, other embodiments are within the scope of the following claims.

The examples set forth above are provided to those of ordinary skill in the art as a complete disclosure and description of how to make and use the embodiments of the disclosure, and are not intended to limit the scope of what the inventor/inventors regard as their disclosure.

Modifications of the above-described modes for carrying out the methods and systems herein disclosed that are obvious to persons of skill in the art are intended to be within the scope of the following claims. All patents and publications mentioned in the specification are indicative of the levels of skill of those skilled in the art to which the disclosure pertains. All references cited in this disclosure are incorporated by reference to the same extent as if each reference had been incorporated by reference in its entirety individually.

It is to be understood that the disclosure is not limited to particular methods or systems, which can, of course, vary. It is also to be understood that the terminology used herein is for the purpose of describing particular embodiments only, and is not intended to be limiting. As used in this specification and the appended claims, the singular forms "a," "an" and "the" include plural referents unless the content clearly dictates otherwise. The term "plurality" includes two or more referents unless the content clearly dictates otherwise. Unless defined otherwise, all technical and scientific terms used herein have the same meaning as commonly understood by one of ordinary skill in the art to which the disclosure pertains.

REFERENCES

1. Blanchette, C. D.; Law, R.; Benner, W. H.; Pesavento, J. B.; Cappuccio, J. A,; Walsworth, V. L.; Kuhn, E. A,; Corzette, M.; Chromy, B. A,; Segelke, B. W.; Coleman, M. A,; Bench, G.; Hoeprich, P. D.; Sulcheck, T. A. *Journal of Lipid Research* 2008, 49, (7), 1420-1430.
2. Borch, J.; Torta, F.; Sligar, S. G.; Roepstos, T. P., *Analytical Chemistry* 2008, 80, (16), 6245-6252.
3. Chromy, B. A.; Arroyo, E.; Blanchette, C. D.; Bench, G.; Benner, H.; Cappuccio, J. A,; Coleman, M. A.; Henderson, P. T.; Hinz, A. K.; Kuhn, E. A.; Pesavento, J. B.; Segelke, B. W.; Sulcheck, T. A.; Tarasow, T.; Walsworth, V. L.; Hoeprich, P. D. *Journal of the American Chemical Society* 2007, 129, 14348-14354.

4. Cracknell, J. A.; Vincent, K. A.; Ludwig, M.; Lenz, 0.; Friedrich, B.; Armstrong, F. A. *Journal of the American Chemical Society* 2007, 130, 424-425.
5. Kovacs, K. L.; Maroti, G.; Rakhely, G. *International Journal of Hydrogen Energy* 2006, 31, (1 I), 1460-1468
6. Fischer et al. *Bioconjugate Chemistry* 2010, 21: 1018-1022.
7. Goldet, G.; Wait, A. F.; Cracknell, J. A, Vincent, K. A.; Ludwig, M.; Lenz, 0.; Friedrich, B.; Armstrong, F. A. *Journal of the American Chemical Society* 2008, 130, (33), 1 1106-1113.
8. Hedderich, R. *Journal of Bioenergetics and Biomembranes* 2004, 36, (I), 65-75.
9. Jed O. Eberly and Roger L. Ely *Critical Reviews in Microbiology,* 34:117-130, 2008
10. Parkin, A., Goldet, G. Cavazza, C. Fontecilla-Camps, J., Armstrong, F. J. Am Chem. Soc. 2008, 13 (40) 13410-13416
11. Sun, X. et al. Membrane-Mimetic Films of Asymmetric Phosphtidylcholine Lipid Bolaamphiphiles. *Langmuir* 2006, 22, 1201-1208.
12. Vignais P M.; Billoud B. *Occurrence, Classification, and Biological Function of Hydrogenases: An overview.* Chemical Reviews 2007, 107, 4206-4272.
13. Vuorilehto et al., "Indirect electrochemical reduction of nicotinamide coenzymes", Bioelectrochemistry 65 (2004).

The invention claimed is:

1. A system for hydrogen production, the system comprising a nanolipoprotein particle presenting a nicotinamide co-factor dependent membrane hydrogenase, at least two opposing electrodes comprising a first electrode and a second electrode opposing the first electrode, and an electrically conductive supporting structure between said first electrode and said second electrode, wherein the nanolipoprotein particles are immobilized to the electrically conductive supporting structure and wherein the nanolipoprotein particle, the at least two opposing electrodes and the electrically conductive supporting structure are in a configuration adapted to produce hydrogen.

2. The system according to claim 1, the system further comprising: a voltage generator, connected to the first and second electrode.

3. The system according to claim 2, wherein the voltage generator is configured to create an electric potential of 500 mV between the first and second electrodes.

4. The system according to claim 1, further comprising an ion exchange membrane between the electrically conductive supporting structure and the second electrode.

5. The system according claim 1, wherein the electrically conductive supporting structure is chemically inert.

6. The system according to claim 1, wherein the electrically conductive supporting structure is an electrically conductive porous supporting structure.

7. The system according to claim 6, wherein the electrically conductive porous supporting structure comprises graphite beads having a diameter less than or equal to 400 μm.

8. The system according to claim 6, wherein the electrically conductive porous supporting structure is a mesoporous structure.

9. The system according to claim 8, wherein the mesoporous structure comprises a three-dimensional mesoporous carbon network structure.

10. The system according to claim 9, wherein the mesoporous structure further comprises graphitic carbon material.

11. The system according to claim 8, wherein the mesoporous structure is a graphitic carbon aerogel.

12. The system according to claim 1, further comprising an oxygen removal system configured to remove dissolved oxygen from a buffer solution containing reagents and flowing through the system.

13. The system according to claim 12, wherein the oxygen removal system comprises an argon gas bubbler.

14. The system of claim 1, further comprising a conduit and at least one pump configured to recycle a buffer solution over the electrically conductive supporting structure.

15. A method to produce hydrogen, the method comprising combining protons, a nicotinamide co-factor and a nicotinamide co-factor dependent membrane hydrogenase presented on a nanolipoprotein particle immobilized on an electrically conductive supporting structure for a time and under condition to allow hydrogen production in presence of an electrical current and of an electrically driven redox mediator, the combining performed in the system of claim 1.

16. The method of claim 15, wherein the nicotinamide co-factor dependent membrane hydrogenase is a [Ni/Fe] hydrogenase from *Allochromatium vinosum, Methanosarcina barkeri, Escherichia coli*, and *Rhodospirillum rubrum Desulfomicrobium baculatum* and *Ralstonia* species.

17. The method according to claim 16, wherein the nicotinamide co-factor dependent membrane hydrogenase is a [Ni/Fe] hydrogenase from *Pyrococcus Furiosus.*

18. The method according to claim 15, wherein the nicotinamide co-factor is nicotinamide adenine dinucleotide phosphate.

19. The method according to claim 15, wherein the electrically driven redox mediator comprises a metallic redox mediator.

20. The method according to claim 15, wherein the combining is performed by contacting a solution comprising the protons, the nicotinamide co-factor and the electrically driven/recycled redox mediator with the electrically conductive supporting structure in presence of the electric current.

21. The method according to claim 15, wherein the electrical current is less than 10 milliamps.

22. A system for hydrogen production, the system comprising a nicotinamide co-factor dependent membrane hydrogenase presented on a nanolipoprotein particle; and an electrochemical flow cell comprising a first electrode and a second electrode, an electrically conductive supporting structure wherein the electrochemical flow cell is configured to receive a solution in a space between the first electrode and the second electrode, and wherein the electrically conductive supporting structure is configured to immobilize the nicotinamide co-factor dependent membrane hydrogenase presented on the nanolipoprotein particle and to be exposed to the solution in the electrochemical flow cell in a configuration adapted to produce hydrogen.

23. The system according to claim 22, wherein the electrochemical flow cell comprises the nanolipoprotein particle immobilized on the electrically conductive supporting structure.

24. The system according to claim 22, wherein the electrochemical flow cell further comprises an ion exchange membrane between said first and second electrodes.

25. A method to produce a hydrogen, the method comprising:

providing a solution containing protons, nicotinamide co-factors and one or more electrically driven redox mediators into the electrochemical flow cell of the system of claim 22; and applying a voltage across the first electrode and the second electrode of the electrochemical flow cell.

26. The method according to claim 25, further comprising capturing hydrogen gas generated in the electrochemical flow cell.

27. The method according to claim 25, further comprising removing dissolved oxygen from the solution prior to the providing the solution through the electrochemical flow cell.

28. A method to produce hydrogen, the method comprising:

contacting protons, a nicotinamide co-factor and a nicotinamide co-factor dependent membrane hydrogenase presented on a nanolipoprotein particle for a time and under condition to allow hydrogen production in presence of an electrical current and of an electrically driven redox mediator, the contacting performed in the system of claim 22.

29. The method according to claim 28, wherein the electrically driven redox mediator is a metallic electrically recycled redox mediator.

30. The method according to claim 29, wherein the metallic electrically recycled redox mediator is (pentamethylcyclopentadienyl-2,2'-bipyridine hydrogen) rhodium (I).

31. The method according to claim 28, wherein the nicotinamide co-factor is nicotinamide adenine dinucleotide phosphate.

32. The method according to claim 28, wherein the nicotinamide co-factor dependent membrane hydrogenase is a [Ni/Fe] hydrogenase from *Allochromatium vinosum, Methanosarcina barkeri, Escherichia coli*, and *Rhodospirillum rubrum Desulfomicrobium baculatum* and *Ralstonia* species.

33. The method according to claim 32, wherein the nicotinamide co-factor dependent membrane hydrogenase is a [Ni/Fe] hydrogenase from *Pyrococcus Furiosus*.

34. A system for hydrogen production, the system comprising:

a nicotinamide co-factor, a nicotinamide co-factor dependent membrane hydrogenase presented on a nanolipoprotein particle, at least two opposing electrodes for providing an electric current, and an electrically driven redox mediator for simultaneous combined or sequential use together with the at least two opposing electrodes configured to provide electrons to the nicotinamide co-factor, wherein the nicotinamide co-factor dependent membrane hydrogenase are immobilized on an electrically conductive substrate and wherein the nicotinamide co-factor, the nicotinamide co-factor dependent membrane hydrogenase and electrically driven redox mediator are in a configuration adapted to produce hydrogen.

35. The system according to claim 34, wherein the electrically driven redox mediator is a metallic electrically recycled redox mediator.

36. The system according to claim 35, wherein the metallic electrically recycled redox mediator is (pentamethylcyclopentadienyl-2,2'-bipyridine hydrogen) rhodium (I).

37. The system according to claim 35, wherein the nicotinamide co-factor is nicotinamide adenine dinucleotide phosphate.

38. The system according to claim 37, wherein the nicotinamide co-factor dependent membrane hydrogenase is a [Ni/Fe] hydrogenase from *Allochromatium vinosum, Methanosarcina barkeri, Escherichia coli*, and *Rhodospirillum rubrum Desulfomicrobium baculatum* and *Ralstonia* species.

39. The system according to claim 37, wherein the nicotinamide co-factor dependent membrane hydrogenase is a [Ni/Fe] hydrogenase from *Pyrococcus Furiosus*.

* * * * *